US011421617B2

(12) United States Patent
Shirakawa et al.

(10) Patent No.: US 11,421,617 B2
(45) Date of Patent: Aug. 23, 2022

(54) INJECTION CONTROL DEVICE

(71) Applicant: DENSO CORPORATION, Kariya (JP)

(72) Inventors: Hiroaki Shirakawa, Kariya (JP); Masashi Inaba, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/126,535

(22) Filed: Dec. 18, 2020

(65) Prior Publication Data

US 2021/0189988 A1 Jun. 24, 2021

(30) Foreign Application Priority Data

Dec. 23, 2019 (JP) ..... JP2019-231504

(51) Int. Cl.
*F02D 41/20* (2006.01)
*F02M 51/00* (2006.01)

(52) U.S. Cl.
CPC ..... *F02D 41/20* (2013.01); *F02M 51/00* (2013.01); *F02D 2041/202* (2013.01); *F02D 2041/2006* (2013.01); *F02D 2041/2058* (2013.01)

(58) Field of Classification Search
CPC ..... F02D 41/20; F02D 2041/202; F02D 2041/2041; F02D 2041/2058; F02D 2041/2003–2093; F02M 51/00
See application file for complete search history.

(56) References Cited

U.S. PATENT DOCUMENTS 8,081,498 B2 * 12/2011 Mayuzumi ..... F02D 41/20 363/59
2021/0189986 A1 6/2021 Shirakawa et al.

FOREIGN PATENT DOCUMENTS

JP 2016-183597 A 10/2016
JP 2018-96229 A 6/2018

* cited by examiner

*Primary Examiner* — Hung Q Nguyen
*Assistant Examiner* — Mark L. Greene
(74) *Attorney, Agent, or Firm* — Posz Law Group, PLC

(57) ABSTRACT

An injection control device includes a boost controller performing boost control of a boosted voltage until a boosted voltage, which is generated in a boost capacitor, rises to a full-charge threshold when the boosted voltage falls below a charge start threshold. A drive unit supplies electric current to a fuel injection valve from a start timing t1 of an injection instruction period. A power interruption controller interrupts electric current supplied to the fuel injection valve by the drive unit. A regeneration unit regenerates electric current generated in the fuel injection valve which is caused by interruption control by the power interruption controller to the boost capacitor of the booster circuit.

16 Claims, 16 Drawing Sheets

INJECTION CONTROL DEVICE

CROSS REFERENCE TO RELATED APPLICATION

The present application is based on and claims the benefit of priority of Japanese Patent Application No. 2019-231504, filed on Dec. 23, 2019, the disclosure of which is incorporated herein by reference.

TECHNICAL FIELD

The present disclosure generally relates to an injection control device that controls valve opening/closing of a fuel injection valve.

BACKGROUND INFORMATION

The injection control device opens and closes a fuel injection valve to inject fuel. The injection control device is configured to perform valve opening control by applying a high voltage to an electrically-operated fuel injection valve. Since the high voltage is required, the injection control device is equipped with a boost controller. That is, the boost controller boost-controls a battery voltage that is a reference power supply voltage of a power supply circuit, and applies the boosted voltage to the fuel injection valve to control the valve opening. When electric power is consumed by applying the boosted voltage to the fuel injection valve, the boosted voltage decreases. Therefore, the boost controller is configured to perform the boost control until the boosted voltage rises to a full-charge threshold when the boosted voltage falls below a charge start threshold.

However, when a regenerative current flows through a boost capacitor of the booster circuit, a floating voltage occurs due to the effect of an equivalent series resistor (ESR) of the boost capacitor. Then, the boosted voltage temporarily exceeds the full-charge threshold, and the boost controller "falsely" stops the boost control before the boosted voltage "truely" reaches the full-charge threshold. Then, the boosted voltage of the booster circuit is not sufficiently accumulated. Further, if the regenerative current flows during the boost control by the boost controller, the regenerative current and the boost control current for boost control may add up to exceed the rated current of the boost capacitor.

SUMMARY

It is an object of the present disclosure to provide an injection control device capable of performing boost control at an appropriate timing.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
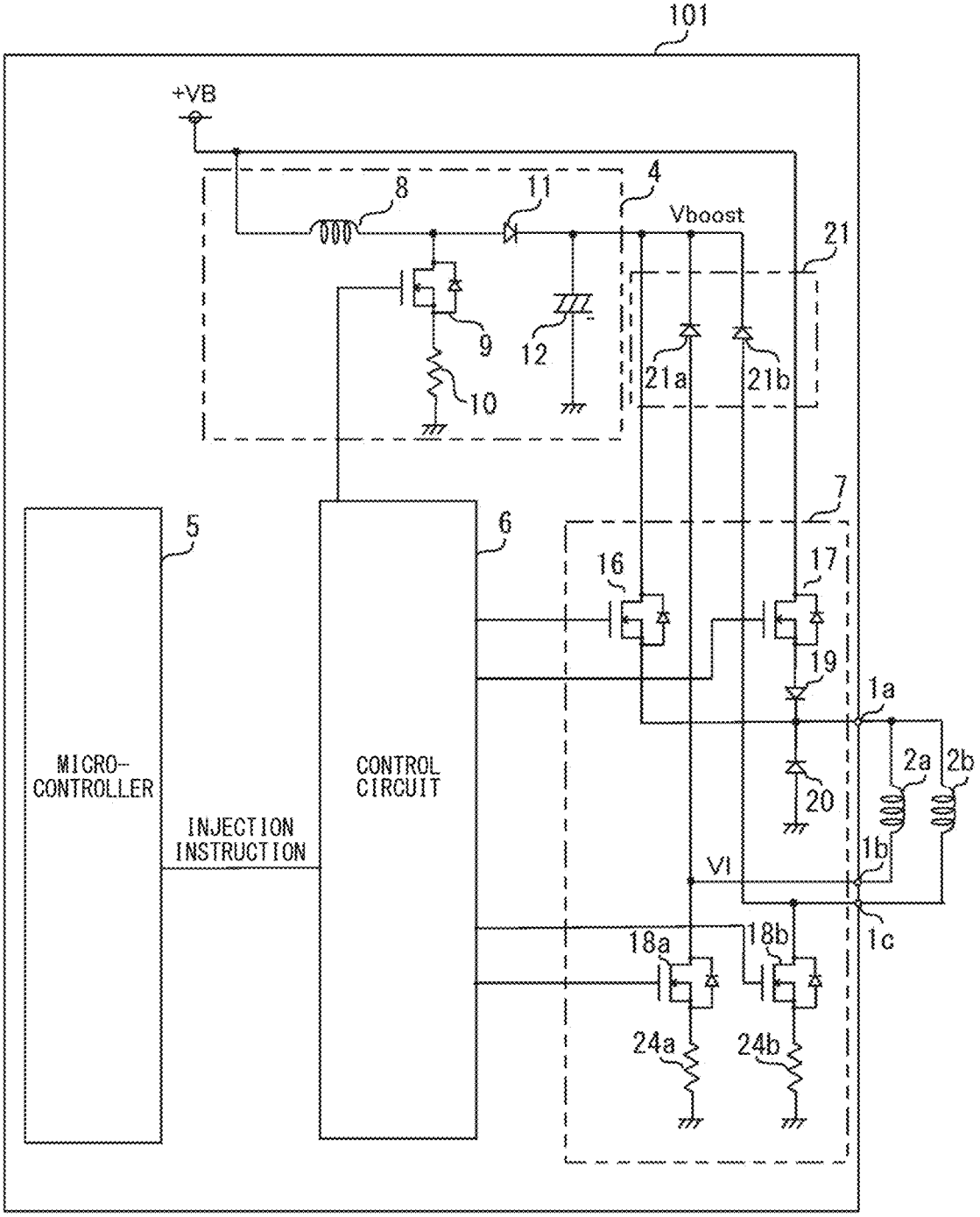
FIG. 1 is an electrical configuration diagram of an electronic control device according to a first embodiment.

Hereinafter, embodiments of an injection control device are described with reference to the drawings.

In each of the embodiments described below, the same or similar reference numerals are used to designate the same or similar configurations, and redundancy of description of the similar configurations is eliminated as required.

First Embodiment

As illustrated in FIG. 1, an electronic control device 101 is used to drive an injector including, for example, N pieces of fuel injection valves 2*a* and 2*b* of a solenoid type for injecting/supplying fuel to an N-cylinder internal combustion engine mounted on a vehicle such as an automobile. The electronic control device 101 has a function as an injection control device that controls the injection by supplying an electric current to the fuel injection valves 2*a* and 2*b*.

The electronic control device 101 is configured to include a booster circuit 4, a microcomputer or microcontroller 5 that outputs an injection instruction signal, a control circuit 6, and a drive unit 7. The booster circuit 4 is composed of, for example, an inductor 8, a MOS transistor 9 serving as a switching element, a current detection resistor 10, a diode 11, and a DCDC converter using a boost chopper circuit having a boost capacitor 12 in the illustrated form. The booster circuit 4 boosts a power supply voltage VB based on a battery voltage to generate a boosted voltage Vboost in the boost capacitor 12. The configuration of the booster circuit 4 is not limited to the illustrated form shown in FIG. 1. Instead, various forms can be applied.

The microcomputer 5 is configured to include a CPU, a ROM, a RAM, an I/O, etc. (none of which is shown), and performs various processing operations based on programs stored in the ROM. The microcomputer 5 calculates an injection instruction timing based on a sensor signal from a sensor (not shown) provided outside of the electronic control device 101, and outputs a fuel injection instruction signal to the control circuit 6 at such injection instruction timing.

The control circuit 6 is, for example, an integrated circuit device based on ASIC (Application Specific Integrated Circuit), and includes, for example, (i) a controller such as a logic circuit, a CPU and the like, and (ii) a storage unit such as RAM, ROM, and EEPROM (both of which are not shown), (iii) a comparison unit including a comparator, and the like, and is configured to execute various controls based on hardware and software.

Figure 2:
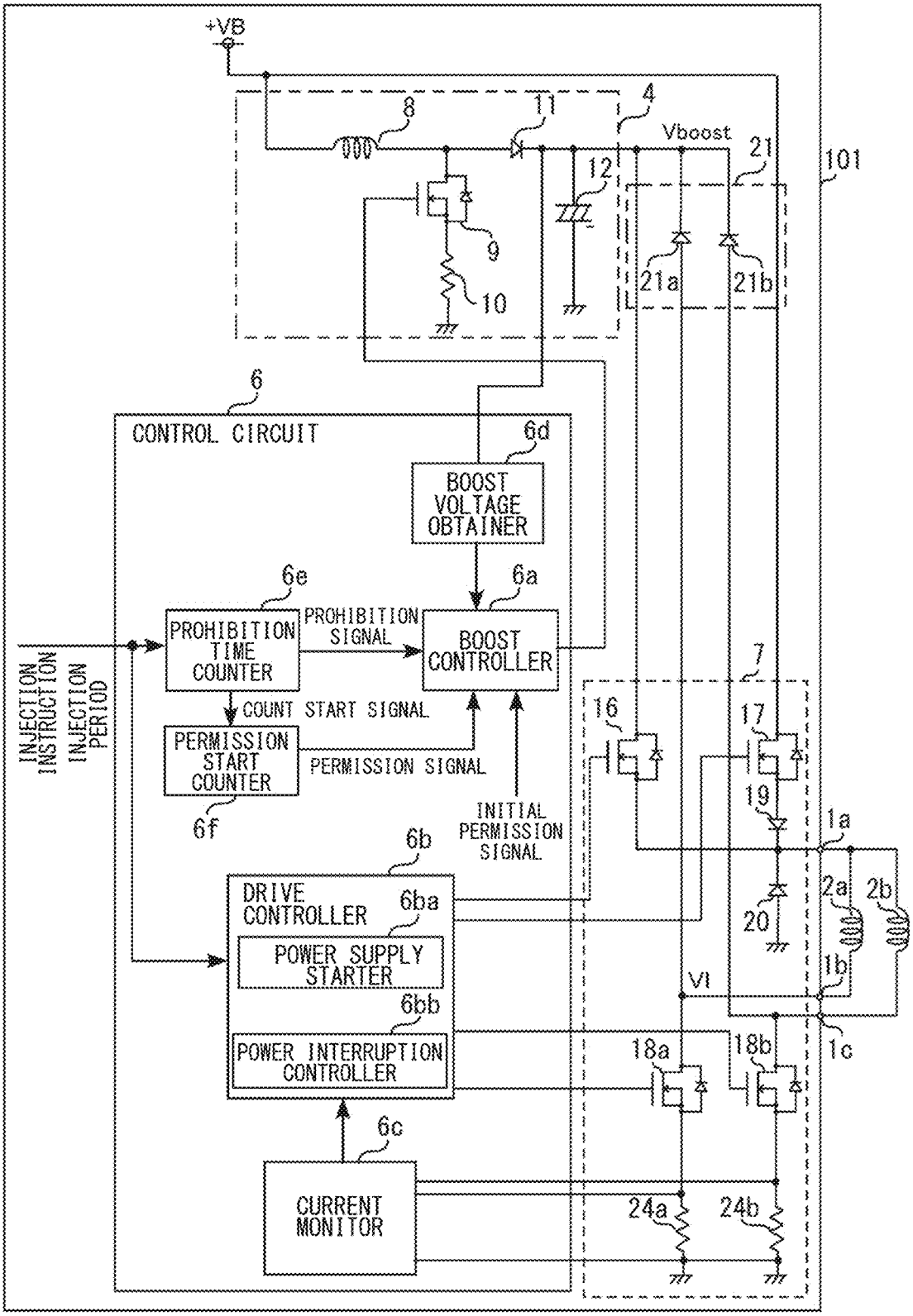
FIG. 2 is a diagram schematically illustrating control contents in a control circuit according to the first embodiment.

As illustrated in a diagram of control contents of FIG. 2, the control circuit 6 provides various functions such as a function of a boost controller 6*a* that controls voltage boosting by the booster circuit 4, a function of a drive controller 6*b* that controls the drive of the drive unit 7, a function of a current monitor 6*c* that monitors the electric currents, a function of a boost voltage obtainer 6*d*, a function of prohibition time counter 6*ea* prohibition time counter 6*e*, and a function of permission start counter 6*fa* permission start permission start counter 6*f*.

When the power supply voltage VB is applied to the microcomputer 5 and the control circuit 6, the boost controller 6*a*, upon receiving an input of an initial permission signal, obtains a voltage between an upper terminal of the boost capacitor 12 and a ground node via the boost voltage obtainer 6*d* as well as detecting an electric current flowing in the current detection resistor 10 via a current monitor 6*c*, and performs ON/OFF control of the MOS transistor 9, for a boost control of the booster circuit 4.

The boost controller 6*a* performs ON/OFF switching control of the MOS transistor 9 of the booster circuit 4 shown in FIG. 1, thereby rectifying the electric current energy accumulated in the inductor 8 through the diode 11 and supplying the electric current energy to the boost capacitor 12. The boost capacitor 12 is charged with the boosted voltage Vboost.

The boost controller 6*a* obtains the boosted voltage Vboost by monitoring the voltage between the upper terminal of the boost capacitor 12 and the ground node by the boost voltage obtainer 6*d*, and starts the boost control when the boosted voltage Vboost falls below a predetermined charge-start threshold VtI (FIG. 3), and continues the boost control until the boosted voltage Vboost reaches a full-charge threshold VhI that is set to be higher than the charge start threshold VtI. In such manner, normally, the boost controller 6*a* can output the boosted voltage Vboost while controlling the boosted voltage Vboost close to the full-charge threshold VhI.

The drive controller 6*b* controls energization of an electric current in order to open and close the fuel injection valves 2*a* and 2*b*, and performs ON/OFF control of a discharge switch 16, a constant current switch 17, and a low-side drive switches 18*a* and 18*b* while detecting the electric current flowing through the fuel injection valves 2*a* and 2*b* by the current monitor 6*c*. The drive controller 6*b* has functions as a power supply starter 6*ba* and a power interruption controller 6*bb*. The power supply starter 6*ba* performs control when starting energization (i.e., when starting supply of electric current), and the power interruption controller 6*bb* performs control when cutting off or stopping energization (i.e., when stopping supply of electric current).

As shown in FIGS. 1 and 2, the drive unit 7 includes, as its main components, the discharge switch 16 for turning ON/OFF the boosted voltage Vboost to the fuel injection valves 2*a* and 2*b*, the constant current switch 17 for performing a constant current control using the power supply voltage VB and the low-side drive switches 18*a* and 18*b*.

As shown in FIG. 1, the drive unit 7 is configured by connecting other peripheral circuits, such as a diode 19, a reflux diode 20 and current detection resistors 24*a* and 24*b* in the illustrated form, for example. The drive unit 7 applies the boosted voltage Vboost to the fuel injection valves 2*a* and 2*b* to increase the supply of electric current up to a peak current threshold Ip for valve opening, and then supplies a constant current that is set to be lower than the peak current threshold Ip. The current monitor 6*c* of the control circuit 6 shown in FIG. 2 detects the electric current flowing through the electric current detection resistors 24*a* and 24*b*. Further, the regeneration unit 21 is configured by connecting the diodes 21*a* and 21*b* in the form shown in FIG. 1.

The (boost voltage) discharge switch 16, the constant current switch 17, and the low-side drive switches 18*a* and 18*b* may be n-channel type MOS transistors. Although these switches 16, 17, 18*a*, and 18*b* may be other types of transistors (for example, bipolar transistors), the present embodiment describes an example where these switches are made by using n-channel type MOS transistors.

Hereinafter, the circuit configuration example shown in FIG. 1 is described, in which the drain, the source, and the gate of the discharge switch 16 respectively mean a drain, a source, and a gate of a MOS transistor serving as the discharge switch 16. Similarly, when described as a drain, a source, and a gate of the constant current switch 17, that means a drain, a source, and a gate of a MOS transistor that constitutes the constant current switch 17, respectively. Similarly, when described as drains, sources, and gates of the low-side drive switches 18*a* and 18*b*, they mean the drains, the sources, and the gates of the MOS transistors serving as the low-side drive switches 18*a* and 18*b*, respectively.

The boosted voltage Vboost is supplied from the booster circuit 4 to the drain of the discharge switch 16. The source of the discharge switch 16 is connected to a high side terminal 1*a*, and the gate of the discharge switch 16 receives a control signal from the drive controller 6*b* (see FIG. 2) of the control circuit 6. In such manner, the (boosted voltage) discharge switch 16 can supply the boosted voltage Vboost of the booster circuit 4 to a high-side terminal 1*a* under the control of the drive controller 6*b* of the control circuit 6.

The power supply voltage VB is supplied to the drain of the constant current switch 17. The source of the constant current switch 17 is connected to the high-side terminal 1*a* via the diode 19 in the forward direction. A control signal is applied to the gate of the constant current switch 17 from the drive controller 6*b* of the control circuit 6. In such manner, the constant current switch 17 can energize the high-side terminal 1*a* with the power supply voltage VB under the control of the drive controller 6*b* of the control circuit 6.

The diode 19 is connected to prevent backflow from an output node of the boosted voltage Vboost of the booster circuit 4 to an output node of the power supply voltage VB of the booster circuit 4 when both switches 16 and 17 are turned ON. The reflux diode 20 is reversely connected at a position between the high-side terminal 1*a* and the ground node. The reflux diode 20 is connected to a path for returning an electric current when the fuel injection valves 2*a* and 2*b* are turned OFF (i.e., when an electric current flowing through switches 16 and/or 17 to the valves is interrupted).

The fuel injection valves 2*a* and 2*b* are connected at positions between the high-side terminal 1*a* and low-side terminals 1*b* and 1*c*, respectively. At a position between the low-side terminal 1*b* and the ground node, the drain and source of the low-side drive switch 18*a* and the electric current detection resistor 24*a* are connected in series. At a position between the low-side terminal 1*c* and the ground node, the drain and source of the low-side drive switch 18*b* and the electric current detection resistor 24*b* are connected in series. The current detection resistors 24*a* and 24*b* are provided for detecting the electric current supplied to the fuel injection valves 2*a* and 2*b*, which are respectively set to about 0.03Ω, for example.

The sources of the low-side drive switches 18*a* and 18*b* are connected to the ground node through the electric current detection resistors 24*a* and 24*b*, respectively. The gates of the low-side drive switches 18*a* and 18*b* are connected to the drive controller 6*b* of the control circuit 6. In such manner, the low-side drive switches 18*a* and 18*b* can selectively switch energization of the electric current flowing through the fuel injection valves 2*a* and 2*b* under the control of the drive controller 6*b* of the control circuit 6.

Further, the diodes 21*a* and 21*b* of the regeneration unit 21 are connected at positions between the low-side terminals 1*b* and 1*c* and the output node of the boosted voltage Vboost by the booster circuit 4, respectively. The diodes 21*a* and 21*b* of the regeneration unit 21 are connected to an energization path of the regenerative currents flowing through the fuel injection valves 2*a* and 2*b* when the fuel injection valves 2*a* and 2*b* are de-energized (i.e., when power supply to the valves 2*a* and 2*b* is interrupted), for regeneration of the electric current to the boost capacitor 12. As a result, the diodes 21*a* and 21*b* are configured to be able to regenerate an electric current (to pass a regenerative current) to the boost capacitor 12 of the booster circuit 4 when the fuel injection valves 2*a* and 2*b* are de-energized (i.e., when power supply to the valves 2*a* and 2*b* is interrupted).

The characteristic operation of the above basic configuration is described below. When the power supply voltage VB based on the battery voltage is applied to the electronic control device 101, the microcomputer 5 and the control circuit 6 are activated. When the control circuit 6 outputs the initial permission signal to the boost controller 6*a*, the boost controller 6*a* outputs a boost control pulse to the gate of the MOS transistor 9 (also known as a boost transistor) to control ON/OFF of the MOS transistor 9. When the MOS transistor 9 turns ON, an electric current flows through the inductor 8, the MOS transistor 9, and the electric current detection resistor 10. When the MOS transistor 9 is turned OFF, an electric current based on the energy stored in the inductor 8 flows through the diode 11 to the boost capacitor 12, and the voltage across the terminals of the boost capacitor 12 rises.

When the boost controller 6*a* of the control circuit 6 repeats the ON/OFF control of the MOS transistor 9 by outputting the boost control pulse, the boosted voltage Vboost charged in the boost capacitor 12 exceeds the power supply voltage VB. After that, the boosted voltage Vboost of the boost capacitor 12 reaches the full-charge threshold VhI (≈65V) exceeding the power supply voltage VB. The boost controller 6*a* obtains the boosted voltage Vboost by the boost voltage obtainer 6*d* and stops outputting the boost control pulse when detecting that the boosted voltage Vboost reaches the full-charge threshold VhI. As a result, the boosted voltage Vboost is maintained near, i.e., close to, the full-charge threshold VhI (see time t1 in FIG. 3).

Figure 3:
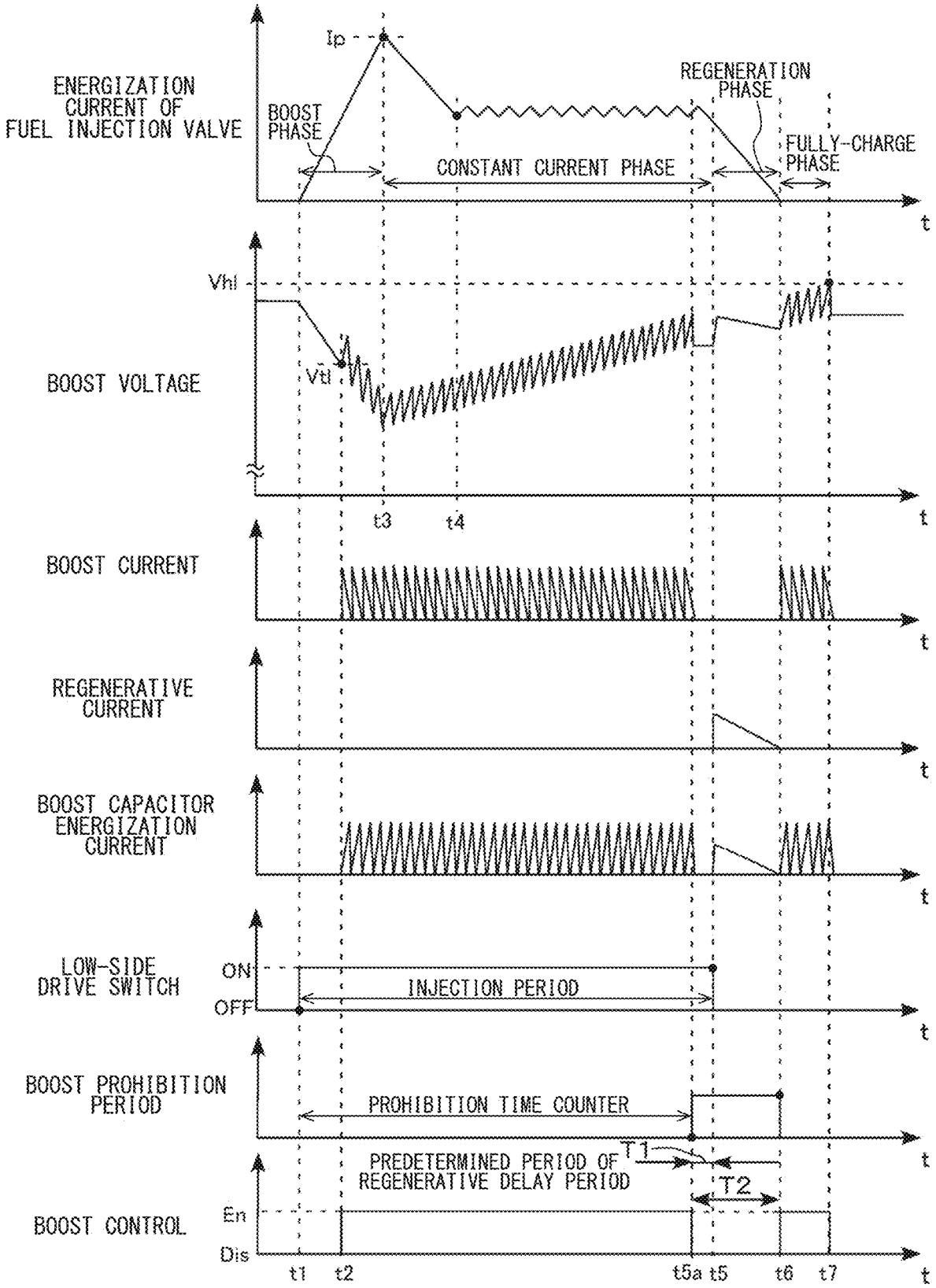
FIG. 3 is a timing chart schematically showing a signal change of each part according to the first embodiment.

When the microcomputer 5 outputs an injection start instruction of the injection instruction signal of the fuel injection valve 2*a* to the control circuit 6 at start timing t1 of an injection period in FIG. 3, for example. At such timing, the microcomputer 5 outputs, together with the injection start instruction, information of an injection period to the control circuit 6. The control circuit 6, upon receiving an input of the injection period, calculates a counter threshold of the prohibition time counter 6*e*. The counter threshold is calculable (i) by adding an injection period input from the microcomputer to an absolute time of timing t1 and (ii) by subtracting a predetermined first period T1 (see FIG. 3) which is a margin time set in advance therefrom. In such manner, timing t5*a* before end timing t5 of the injection instruction period by an amount/duration of the predetermined first period T1 is calculable. Then, the prohibition time counter 6*e* starts counting from start timing t1 of the injection instruction period, and keep counting until a count value of the counter 6*e* reaches the calculated counter threshold.

Further, at timing t1, the drive controller 6*b* of the control circuit 6 causes the power supply starter 6*ba* to perform an ON control of the low-side drive switch 18*a*, and to perform an ON control of the discharge switch 16 and the constant current switch 17. At such timing, the boosted voltage Vboost is applied to a position between the high-side terminal 1*a* and the low-side terminal 1*b* of the fuel injection valve 2*a*, thereby steeply increases the energization current of the fuel injection valve 2*a*. As a result, the charge accumulated in the boost capacitor 12 is consumed by the electric current flowing through the fuel injection valve 2*a*, and the boosted voltage Vboost decreases. Thus the fuel injection valve 2*a* starts to open.

When the boosted voltage Vboost reaches the charge start threshold VtI, the boost controller 6*a* detects that the inter-terminal voltage (i.e., a voltage across the terminals) of the boost capacitor 12 has reached the charge start threshold VtI by the boost voltage obtainer 6*d*, and outputs the boost control pulse to the MOS transistor 9, for starting the boost control (i.e., timing t2 in FIG. 3). In other words, the booster switch 9 starts rapidly turning ON and OFF to try to increase the boost voltage.

The current monitor 6*c* continues to detect the electric current flowing through the fuel injection valve 2*a* by detecting the voltage across the electric current detection resistor 24*a*. When the drive controller 6*b* detects that the peak current threshold Ip is reached, the drive controller 6*b* performs an OFF control of the (boost voltage) discharge switch 16 by the power interruption controller 6*bb* to shut off (i.e., interrupt) the voltage applied to the fuel injection valve 2*a* (i.e., timing t3 in FIG. 3).

At timing t3, the electric current flowing through the fuel injection valve 2*a* is suddenly interrupted, and the boosted voltage Vboost starts to rise after timing t3. The boost controller 6*a* outputs a boost control pulse until the boosted voltage Vboost reaches the full-charge threshold VhI except for a predetermined second period T2 (a boost prohibition period). Refer to timings t3 to t5*a* and t6 to t7 in FIG. 3 for such control.

Then, as shown in a period between timings t4 and t5 in FIG. 3, the drive controller 6*b* performs an ON/OFF control of the constant current switch 17 to control the energization current of the fuel injection valve 2*a* as a predetermined constant current based on the detection current of the current monitor 6*c*. The value of such constant current is adjusted according to the ON/OFF of the constant current switch 17, and both of the maximum value and the minimum value that define the constant current range are set in advance so as to fall below the peak current threshold Ip. Thereby, the drive controller 6*b* can control the electric current flowing through the fuel injection valve 2*a* to be a constant current within a certain range.

On the other hand, the prohibition time counter 6*e* of the control circuit 6 keeps counting from start timing t1, as described above. When the count value of the prohibition time counter 6*e* reached the counter threshold at timing t5*a*, a prohibition signal is output to the boost controller 6*a*. Then, the boost controller stops the boost control. Further, at such timing t5*a*, the prohibition time counter 6*e* outputs a count start signal to the permission start counter 6*f*, for starting counting by the permission start counter 6*f*. The permission start counter 6*f* keeps counting until a count value reaches a counter threshold equivalent to the predetermined second threshold T2. The predetermined second threshold T2 is set in advance to a duration of time that is required for sufficiently lowering the regenerative current generated at a constant current interruption time.

After the lapse of the predetermined first period T1 from timing t5*a*, at timing t5 of FIG. 3, the microcomputer 5 outputs an injection instruction stop signal of the fuel injection valve 2*a* to the control circuit 6. The power interruption controller 6*bb* of the drive controller 6*b* interrupts the constant current by performing an OFF control for both of the constant current switch 17 and the low-side drive switch 18*a*. Alternatively, the injection instruction stop timing at t5 may be based on an injection time counter (not shown) beginning at t1. And the injection time counter counting is fundamentally slightly longer (longer by a value of T1) than the prohibition time counter 6*e*. Alternatively, a single timer may be used (beginning counting at t1) to determine three events in the following order the beginning of the boost prohibition period at t5*a*, the end of the injection period at t5 (starting the regenerative current), and the end of boost prohibition period at t6.

In such case (interruption at t5), the energization current of the fuel injection valve 2*a* sharply decreases, and the magnetization of a stator provided in the fuel injection valve 2*a* can be stopped. As a result, a needle inside the fuel injection valve 2*a*, which has been attracted by an electromagnet of the stator, returns to its original position by an attraction of a biasing force of a biasing unit in response to the disappearance of the electromagnetic force, thereby the fuel injection valve 2*a* is closed.

Further, at timing t5 in FIG. 3, an eclectic current is being supplied to the fuel injection valve 2*a*, and an electric energy is accumulated therein. The regeneration unit 21 can supply a regenerative current based on the accumulated energy to the boost capacitor 12 through the reflux diode 20 and the (first regenerative) diode 21*a*. The boost capacitor 12 is charged with the electric energy from the regenerative current of the regeneration unit 21, and the energy accumulated in the fuel injection valve 2*a* can be reused.

In the predetermined second period T2 (boost prohibition period) of timing t5*a* to t6 in FIG. 3, the boost controller 6*a* stops boost control. During regeneration of electric current to the boost capacitor 12 of the booster circuit 4 via the regeneration unit 21 (from t5 to t6), the boost controller 6*a* stops boost control because regeneration period is within the boost control period, in the present embodiment.

The permission start counter 6*f*, after the lapse of the predetermined second period T2 (boost prohibition period) from timing t5*a*, outputs a permission signal to the boost controller 6*a* at timing t6. The boost controller 6*a* resume boost control by outputting boost control pulses to the booster circuit 4.

Then, after resuming the boost control of the boost controller 6*a*, when the boosted voltage Vboost reaches the full-charge threshold VhI at timing t7 of FIG. 3, the boost controller 6*a* stops boost control by stopping output of the boost control pulses.

Voltage floating may be caused by the effects of equivalent series resistor (ESR) of the boost capacitor 12 if, on an assumption, the boost control by the boost controller 6*a* controlling the booster circuit 4 continues in the predetermined second period T2 (boost prohibition period), which may then cause the detection voltage of the boosted voltage Vboost to temporarily reach the full-charge threshold VhI and may stop the boost control. In such case, the boosted voltage Vboost may be not sufficiently accumulated. Further, the regenerative current flowing in a boost control period by the boost controller 6*a* may add up to exceed the rated (current) value of the boost capacitor 12, in view of the boost current, or the control current of the boosting time.

In the present embodiment, the boost controller 6*a* can suppress the boosting of the boosted voltage Vboost, by temporarily stopping the boost control of the booster circuit 4 in the predetermined second period T2 (boost prohibition period). As a result, even under influence of an equivalent series resistor by the boost capacitor 12, the detection voltage of the boosted voltage Vboost is prevented from temporarily reaching the full-charge threshold VhI. Therefore, the boost control by the boost controller 6*a* is continuable (resumed after the prohibition period) until the boosted voltage Vboost accurately reaches the full-charge threshold VhI.

Further, even when the regenerative current flows to the boost capacitor 12, the electric current (boost capacitor energization current in FIG. 3) is prevented from exceeding the rated current of the boost capacitor 12, thereby high specification circuit element is not required for the circuit path of the boost current and enabling low cost manufacturing of such circuit.

Further, as shown in FIG. 3, the boost current largely fluctuates/changes every time the boost controller 6*a* turns ON/OFF the MOS transistor 9. Thus, depending on the last OFF timing of the MOS transistor 9, the boost current (from boost inductor 8) and the regenerative current may overlap, and the boosted voltage Vboost may temporarily exceed the full-charge threshold Vht. However, the control method of the present embodiment stops the boost control of the boost controller 6*a* at timing t5*a*, which precedes end timing t5 of the injection instruction period. Therefore, the excess of the boosted voltage Vboost exceeding the full-charge threshold VhI is securely preventable. In such manner, false detection of the full-charge threshold VhI is securely avoidable.

According to the present embodiment, the boost controller 6*a* stops boost control of the booster circuit 4 before the regenerative current is regenerated by the regeneration unit 21 to the boost capacitor 12 of the booster circuit 4, from a timing that is after the start timing t1 of the injection instruction period and before interruption control by the power interruption controller 6*bb*.

Specifically, the boost controller 6*a* stops the boost control of the booster circuit 4 before end timing t5 of the injection instruction period at which the predetermined first period T1 ends, and for a duration of when at least the electric current is regenerated to the boost capacitor 12 of the booster circuit 4 by the regeneration unit 21. More specifically, the booster controller 6*a* stops the boost control of the booster circuit 4 for the predetermined second period T2 which starts at t5*a*, or at a timing before t5 by an amount of time of the predetermined first period T1. Thus, false detection of the full-charge threshold VhI is securely avoidable. Predetermined first period T1 is described as a regenerative delay period, from t5*a* (boost prohibition period begins) to t5 (current interruption causing the regenerative current).

Appropriate amount of the predetermined first period T1 and the predetermined second period T2 may be set at the time of manufacturing/inspection in consideration of the individual products character as well as the structure of the fuel injection valves 2*a*, 2*b* and the like. Further, these values may be actively modified depending on factors such as: RPM of motor, temperature of motor, age of valves.

Second Embodiment

Figure 4:
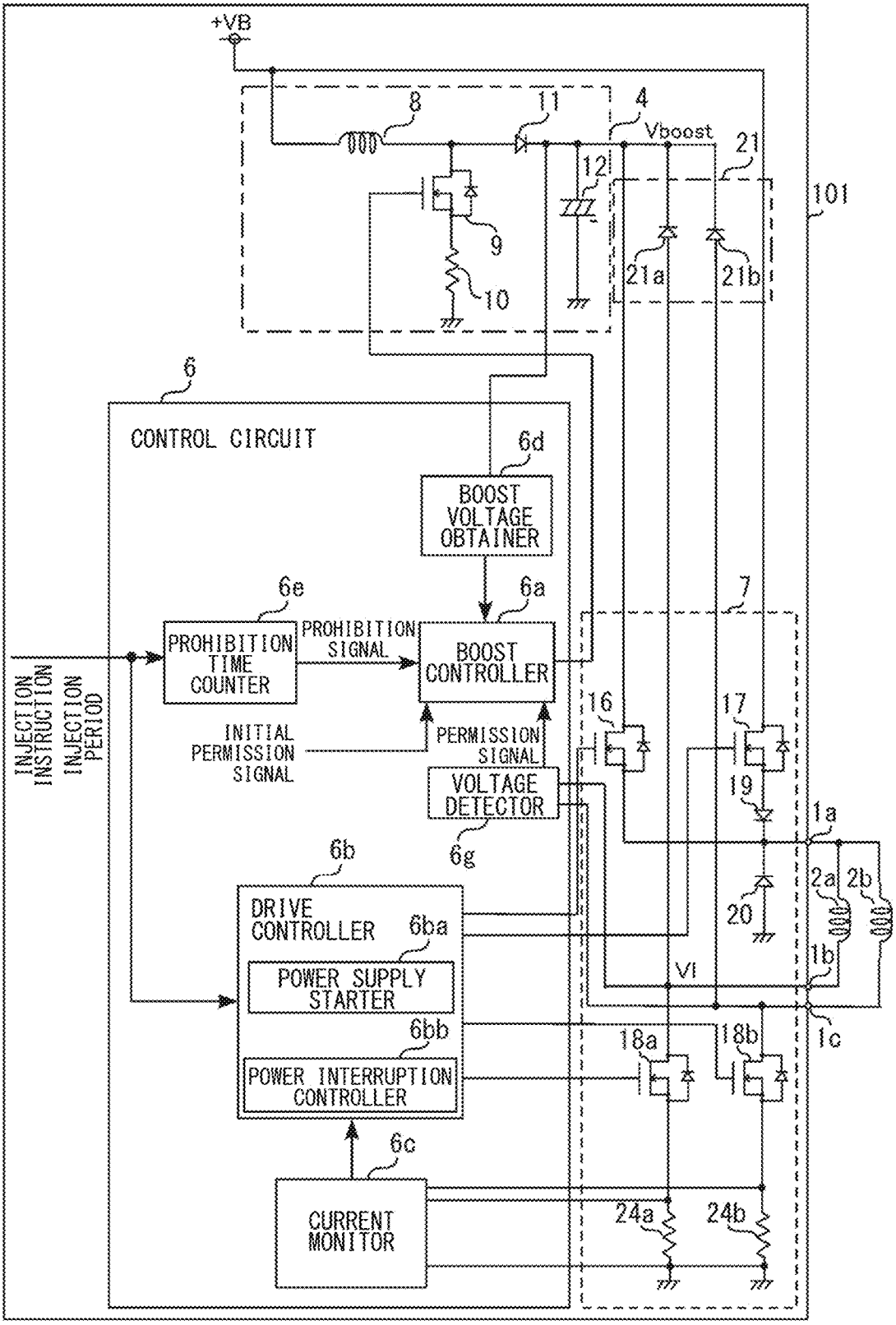
FIG. 4 is a diagram schematically illustrating the control contents in the control circuit according to a second embodiment.
Figure 5:
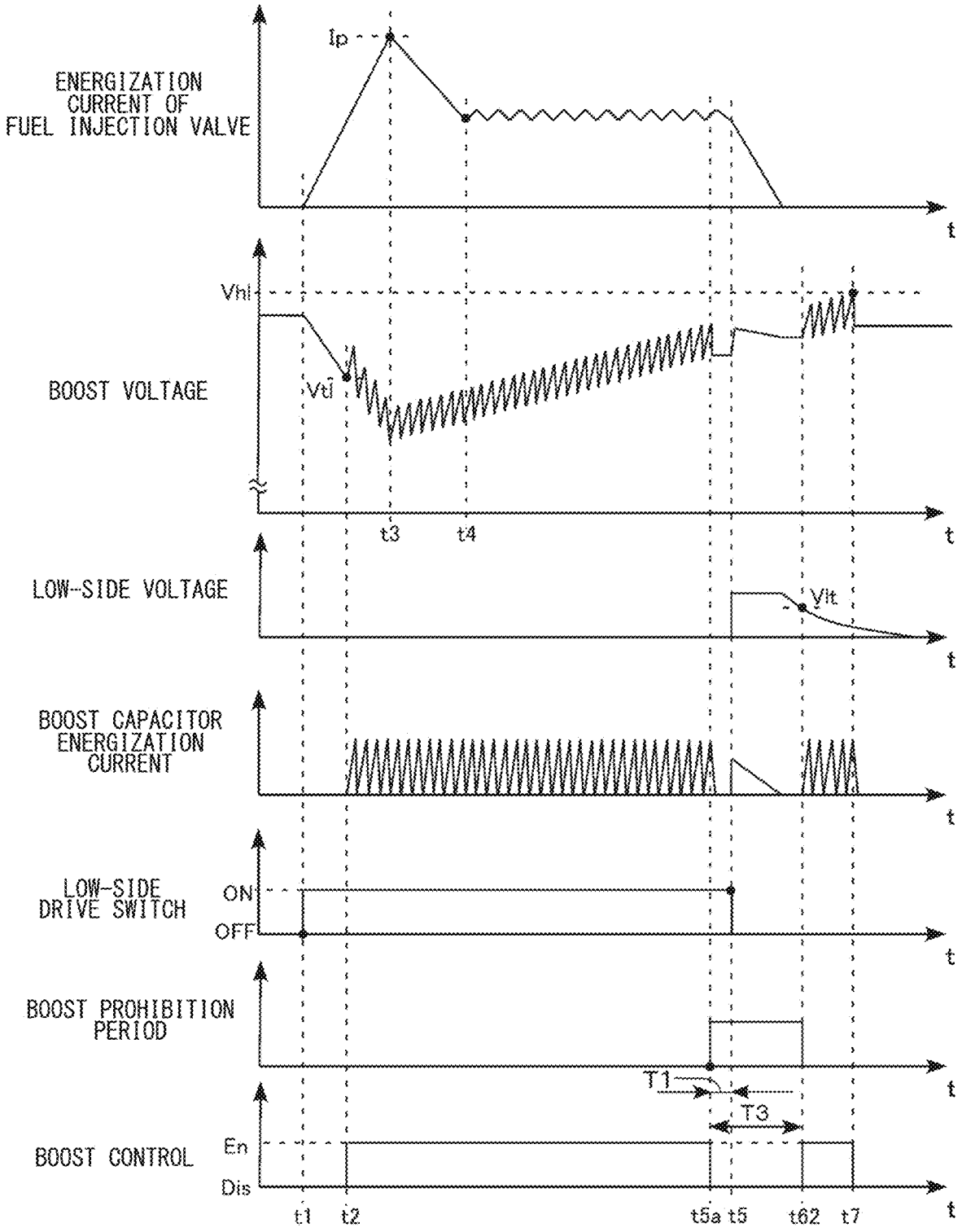
FIG. 5 is a timing chart schematically showing a signal change of each part according to the second embodiment.

FIGS. 4 and 5 show additional explanatory diagrams of the second embodiment. The same parts as those in the above-described embodiment are designated by the same reference numerals and the description thereof is omitted. Below, the parts different from the above-described embodiment are described.

As shown in FIG. 4, the control circuit 6 includes a voltage detector 6*g* that detects a low-side voltage VI of the low-side terminals 1*b* or 1*c*. The voltage detector 6*g* detects a flyback voltage (a regenerative voltage) generated in the fuel injection valves 2*a* or 2*b* when the power interruption controller 6*bb* interrupts, or cuts off the constant current (i.e., when performing an interruption control of the constant current). This interruption turns OFF constant current switch 17 and turns OFF the low-side drive switch (18*a* or 18*b*) associated with whatever fuel injection valve 2*a* or 2*b* was operating.

As shown in FIG. 5, the low-side voltage VI of the low-side terminals 1*b* or 1*c* rises sharply from timing t5 at which the control circuit 6 inputs an injection stop instruction and the interruption control is performed by the power interruption controller 6*bb* and then the low-side voltage VI is saturated. After that, as the regenerative current stops flowing, the low-side voltage VI also gradually decreases.

As shown in the above-described first embodiment (FIG. 3), the prohibition time counter 6*e* outputs a prohibition signal to the boost controller 6*a* in response to the injection stop instruction being input thereto, i.e., in a period from start timing t1 of the injection instruction period to timing t5*a* at which the count value reaches the counter threshold.

However, in the present (second) embodiment (FIG. 5), the voltage detector 6*g* outputs, to the boost controller 6*a*, a permission signal upon detecting a fall of the low-side voltage VI below the predetermined first voltage VIt at timing t62, as shown in FIG. 5. This permission signal ends the boost prohibition period T3, and resumes (enables) boost control). Thus, the boost controller 6*a* starts/resumes/enables boost control at timing t62 after stopping boost control in a boost prohibition period T3 between timing t5*a* and t62.

According to the present/second embodiment, the boost controller 6*a* stops boost control of the booster circuit 4 during a period (i) from a stop timing of the boost control (ii) until it is detected by the voltage detector 6*g* that the flyback voltage generated in the fuel injection valves 2*a* and 2*b* falls below the predetermined first voltage VIt (descriptively known as a threshold-terminating boost-prohibition low-side voltage. As a result, the same effect as that of the above-described embodiment is achievable.

Third Embodiment

Figure 6:
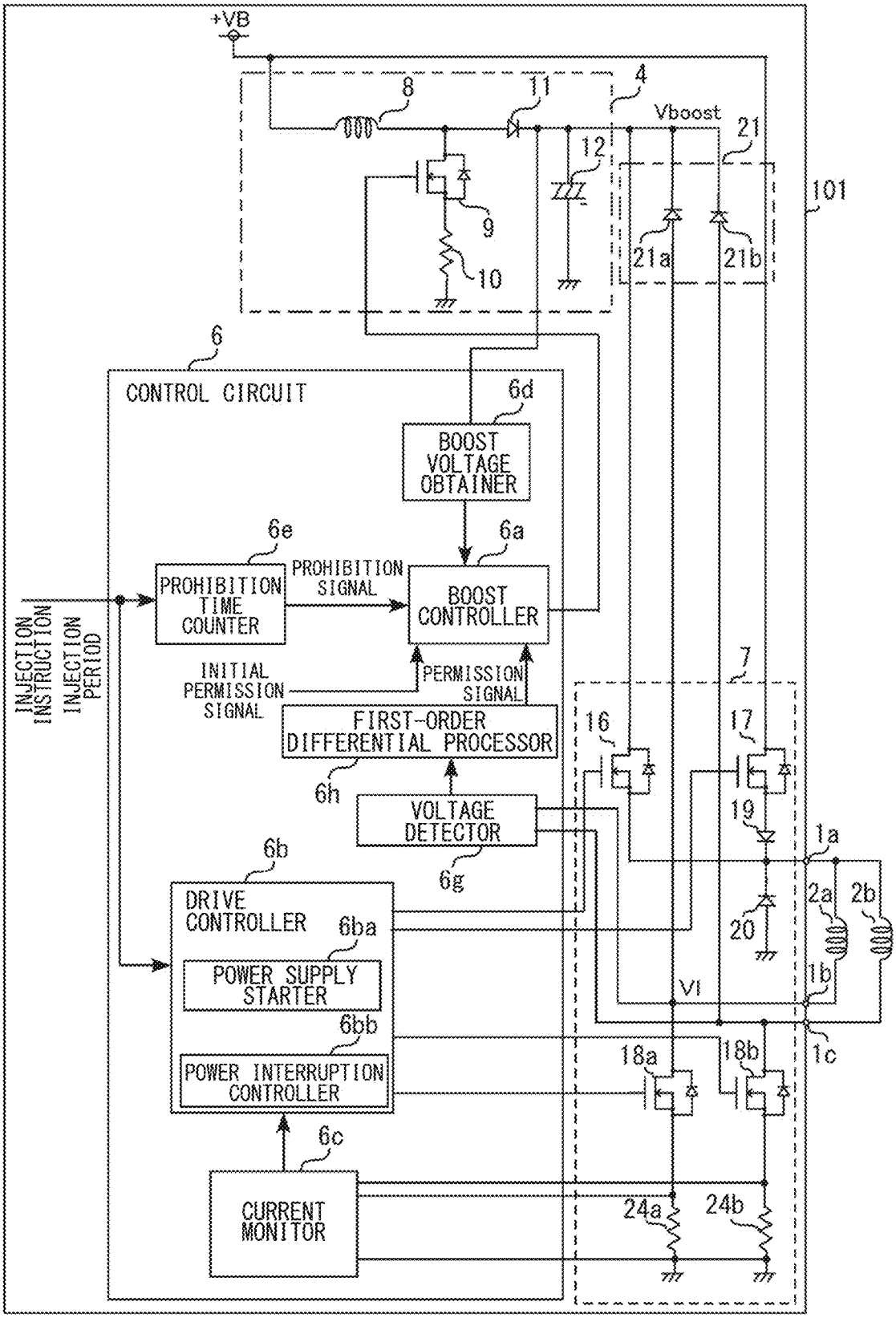
FIG. 6 is a diagram for schematically illustrating the control contents in the control circuit according to a third embodiment.
Figure 7:
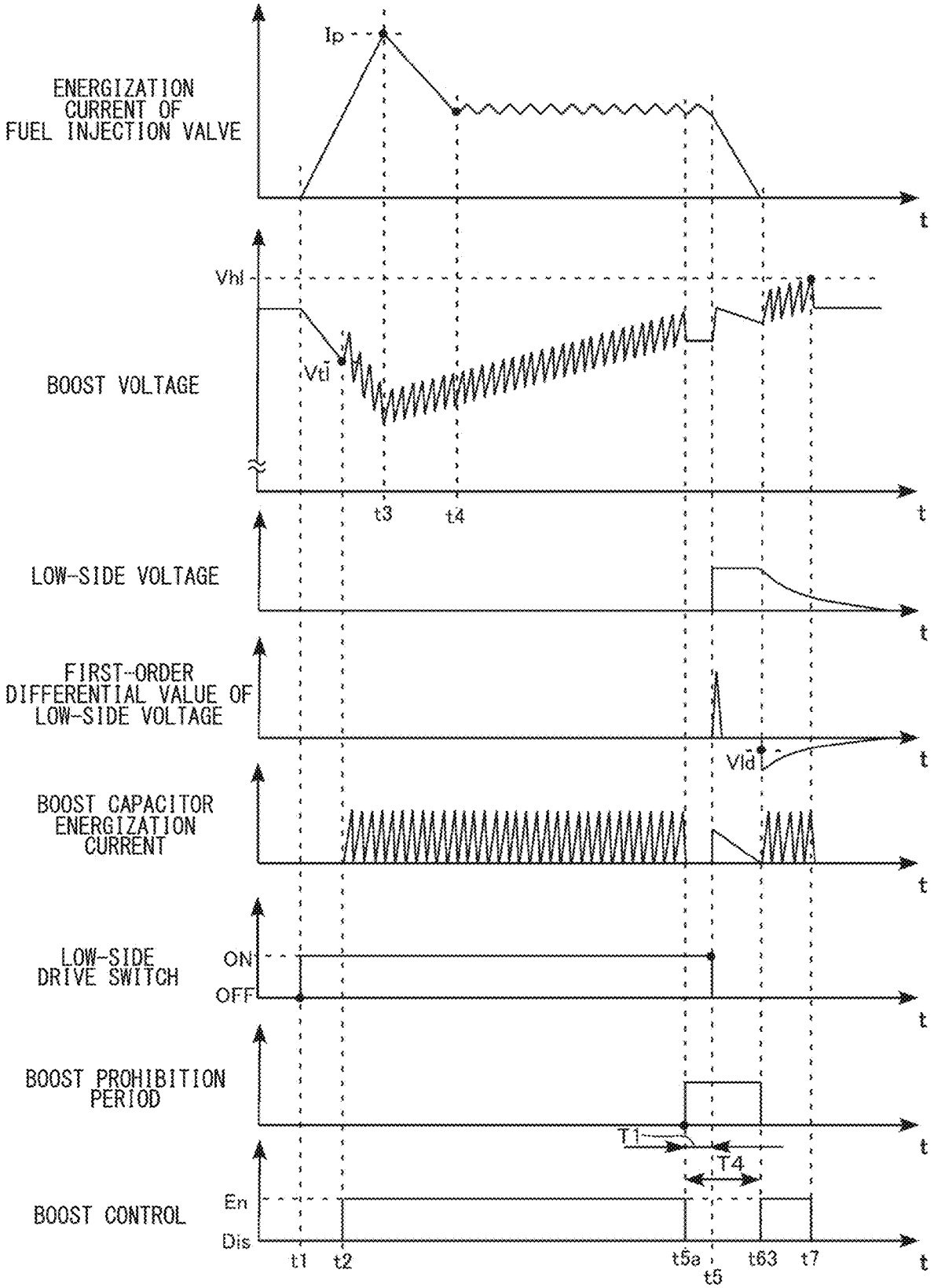
FIG. 7 is a timing chart schematically showing a signal change of each part according to the third embodiment.

FIGS. 6 and 7 show additional explanatory diagrams of the third embodiment. The same parts as those in the above-described embodiment are designated by the same reference numerals and the description thereof is omitted. Below, the parts different from the above-described embodiment is described.

As shown in FIG. 6, the control circuit 6 includes the voltage detector 6*g* that detects the low-side voltage VI of the low-side terminals 1*b* and 1*c*. The voltage detector 6*g* detects a flyback voltage generated in the fuel injection valves 2*a* and 2*b* when the power interruption controller 6*bb* performs an interruption control. The control circuit 6 further includes a first-order differential processor 6*h*. The first-order differential processor 6*h* differentiates the flyback voltage detected by the voltage detector 6*g* once, and outputs a permission signal to the boost controller 6*a* when the differential value satisfies a predetermined condition.

As shown in FIG. 7, the low-side voltage VI of the low-side terminals 1*b* and 1*c* rises sharply from timing t5 when the control circuit 6 inputs the injection stop instruction and the interruption control is performed by the power interruption controller 6*bb*, and is saturated. After that, when the regenerative current stops flowing, the low-side voltage VI also gradually lowers. On the other hand, the first-order differential processor 6*h* calculates the processed value of the first-order differential voltage according to the change in the low-side voltage VI.

As shown in the above-described embodiment, the prohibition time counter 6*e* outputs a prohibition signal to the boost controller 6*a* from an input of an injection start instruction at start timing t1 of the injection instruction period. In the present embodiment, when the voltage detector 6*g* detects (i) that the low-side voltage VI is saturated to the maximum value, and thereafter (ii) at timing t63 (see FIG. 7) that the processed value of the first-order differential voltage obtained by differentiating the low-side voltage VI once by the first-order differential processor 6*h* falls below (i.e., reaches) a predetermined negative threshold VId (descriptively known as a threshold-terminating-first-order low-side value), a permission signal is output to the boost controller 6*a*. Then, the boost controller 6*a* starts boost control at timing t63 (after stopping boost control in a boost prohibition period T4 between timing t5*a* to t63).

According to the present embodiment, the boost controller 6*a* stops boost control of the booster circuit 4 from (i) stop of the boost control (ii) until the processed value of the flyback voltage generated in the fuel injection valves 2*a* or 2*b* by the first-order differential processor 6*h* satisfies a predetermined condition. As a result, the same effect as that of the above-described embodiment is achievable.

Fourth Embodiment

Figure 8:
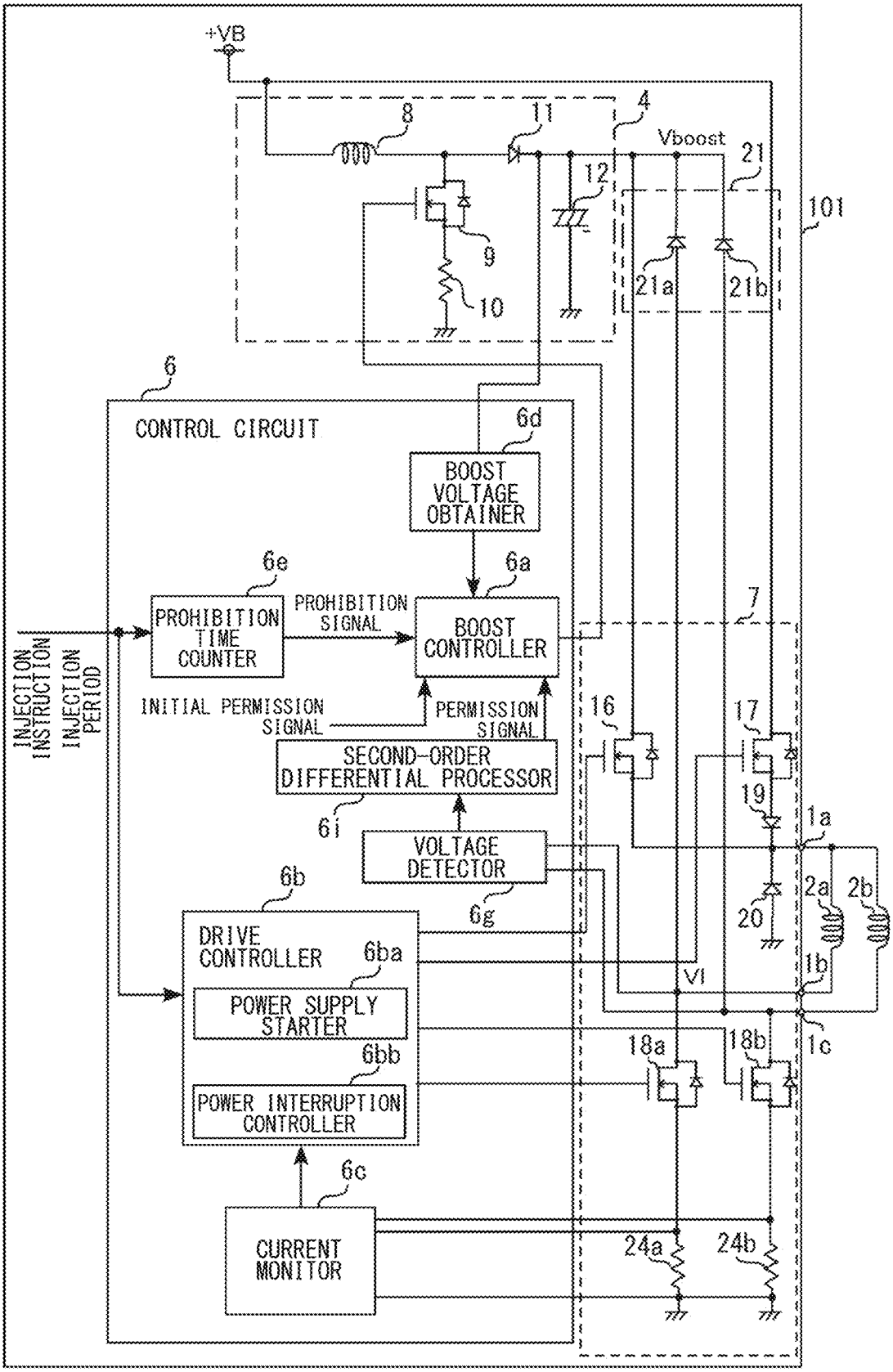
FIG. 8 is a diagram schematically illustrating the control contents in the control circuit according to a fourth embodiment.
Figure 9:
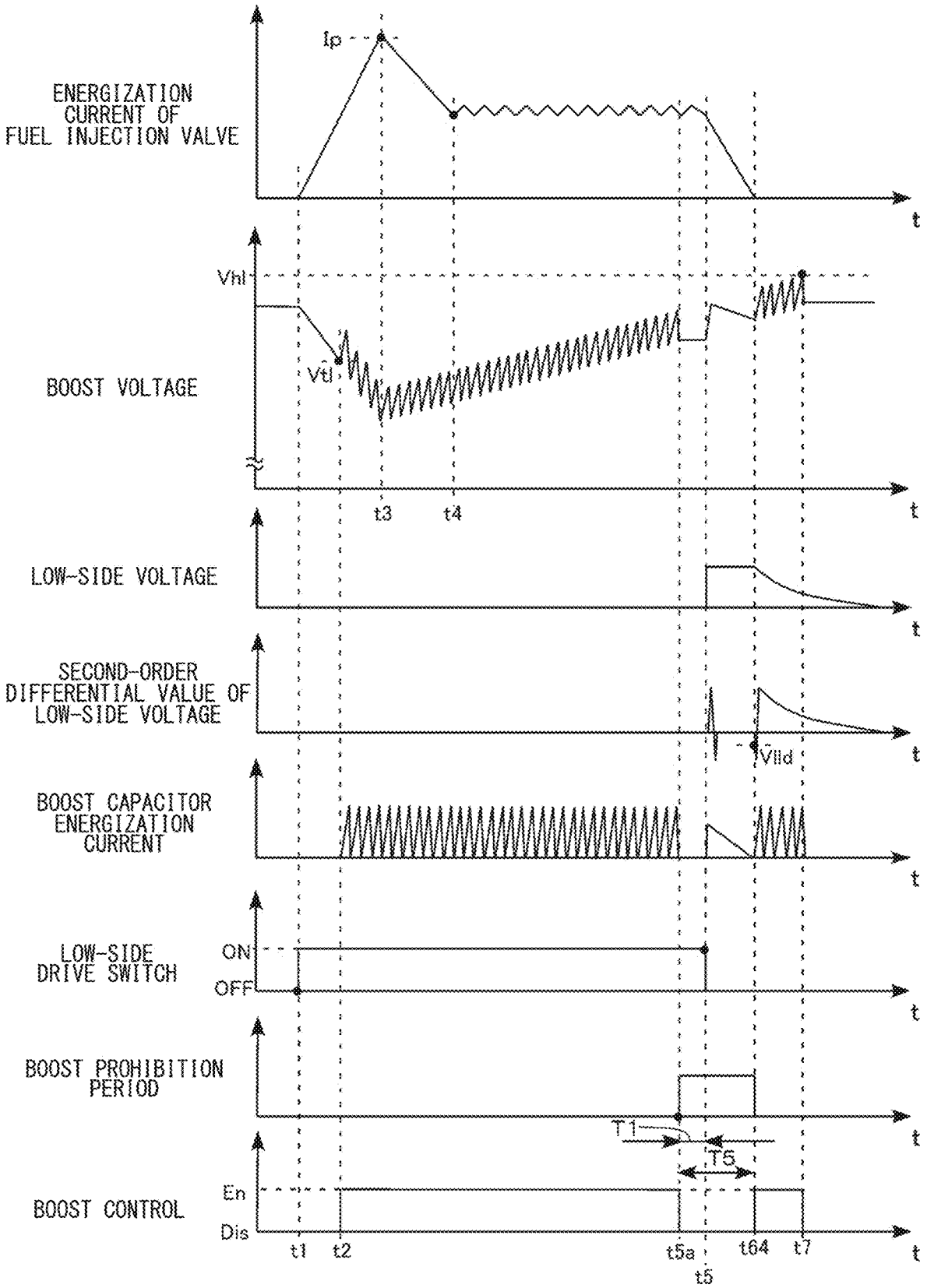
FIG. 9 is a timing chart schematically showing a signal change of each part according to the fourth embodiment.

FIGS. 8 and 9 show additional modifications of the second embodiment. The same parts as those in the above-described embodiment are designated by the same reference numerals and the description thereof is omitted. Below, the parts different from the above-described embodiment is described.

As shown in FIG. 8, the control circuit 6 includes the voltage detector 6*g* that detects the low-side voltage VI of the low-side terminals 1*b* or 1*c*. The voltage detector 6*g* detects the flyback voltage generated in the fuel injection valves 2*a* or 2*b* when the interruption control by the power interruption controller 6*bb* is performed. In addition, the control circuit 6 further includes a second-order differential processor 6*i*. The second-order differential processor 6*i* differentiates the flyback voltage detected by the voltage detector 6*g* twice, and outputs a permission signal to the boost controller 6*a* when the differential value satisfies a predetermined condition.

As shown in FIG. 9, the low-side voltage VI of the low-side terminals 1*b* and 1*c* rises sharply from timing t5 at which the control circuit 6 inputs the injection stop instruction signal and the interruption control is performed by the power interruption controller 6*bb*, and the low-side voltage VI is saturated. After that, when the regenerative current stops flowing, the low-side voltage VI also gradually lowers. On the other hand, the second-order differential processor 6*i* calculates the processed value of the second-order differential voltage according to the change in the low-side voltage VI.

As shown in the above-described embodiment, the prohibition time counter 6*e* outputs a prohibition signal to the boost controller 6*a* from an input of the injection start instruction at start timing t1 of the injection instruction period to timing t5*a* at which the count value reaches the counter threshold. In the present embodiment, when the voltage detector 6*g* detects that the low-side voltage VI is saturated to the maximum value, and, upon detecting that the processed value of the second-order differential voltage by the second-order differential processor 6*i* (i) becomes the maximum and minimum value and (ii) falls below (reached) a predetermined negative threshold VIId, for example, at timing t64 (see FIG. 9), the injection stop detector 6*e* outputs a permission signal to the boost controller 6*a*. Then, after stopping boost control in a boost prohibition period T5 between timings t5*a* and t64, the boost controller 6*a* starts boost control at timing t64.

According to the present (fourth) embodiment, the boost controller 6*a* stops (prohibits) the boost control of the booster circuit 4 (*i*) from a stop of the boost control at t5*a* (ii) until the processed value of the second-order differential voltage of the flyback voltage, which is generated in the fuel injection valves 2*a* or 2*b*, by the second-order differential processor 6*i* satisfies the predetermined condition. As a result, the same effect as that of the above-described embodiment is achievable.

Fifth Embodiment

Figure 10:
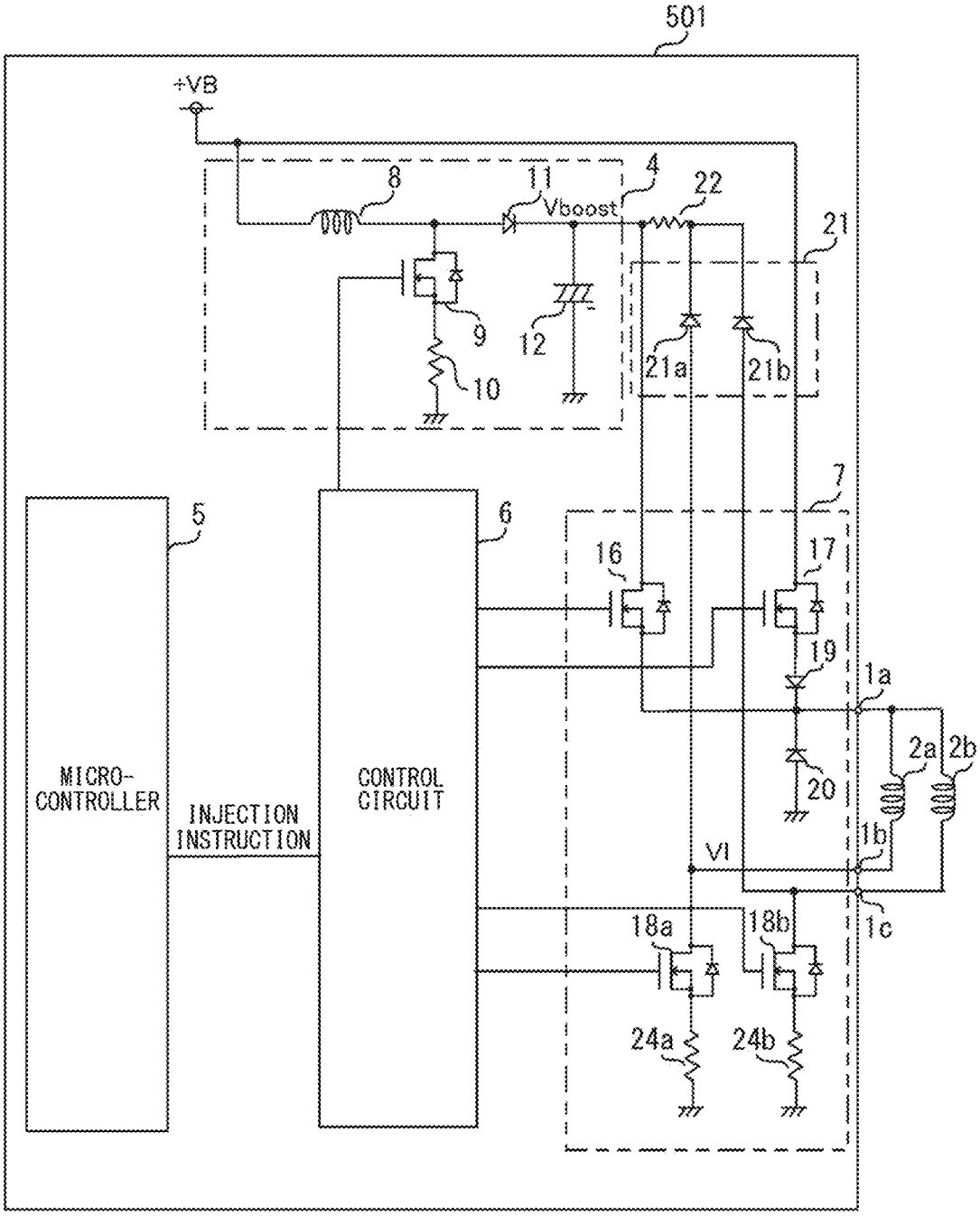
FIG. 10 is an electrical configuration diagram of the electronic control device according to a fifth embodiment.
Figure 11:
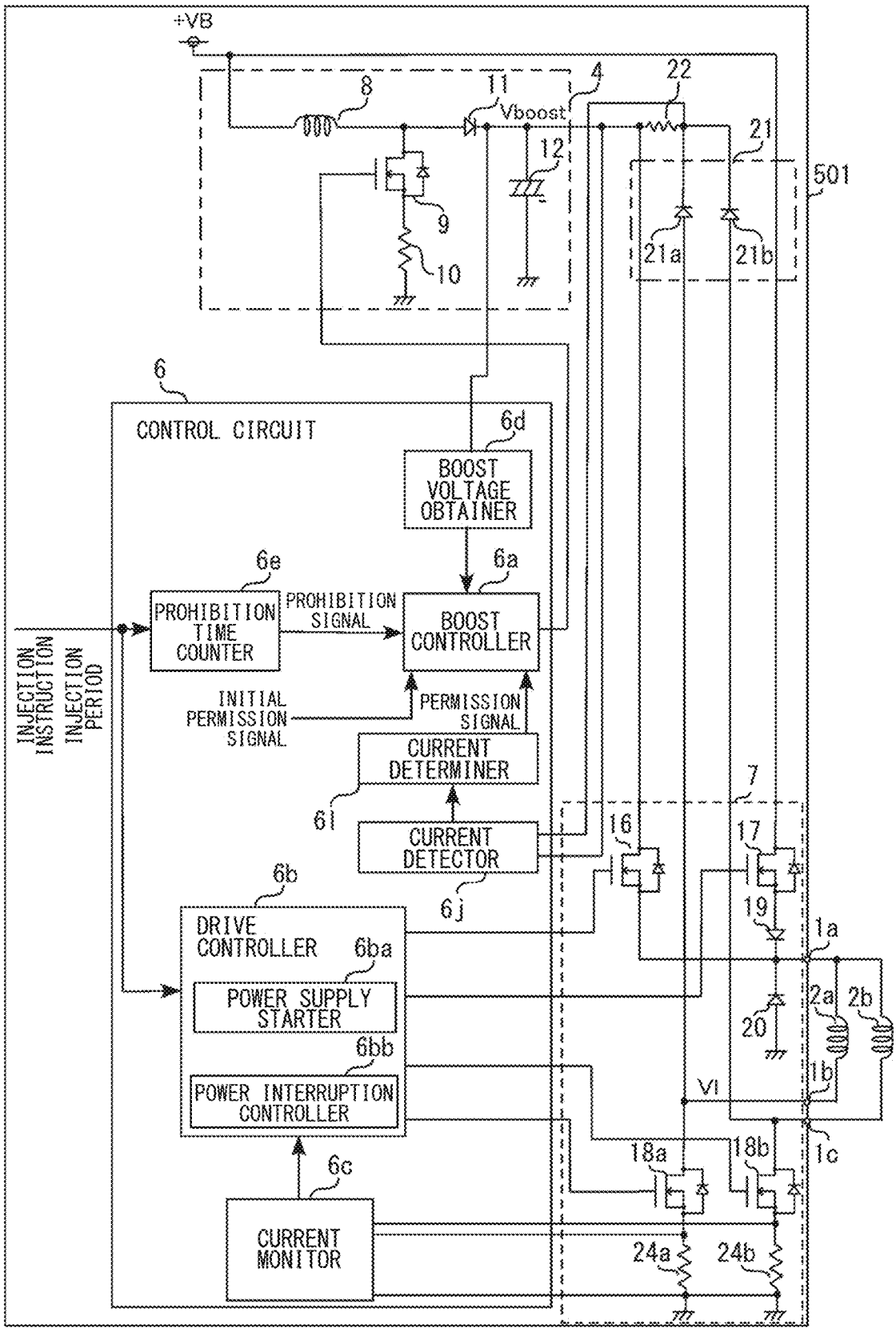
FIG. 11 is a diagram schematically illustrating the control contents in the control circuit according to the fifth embodiment.
Figure 12:
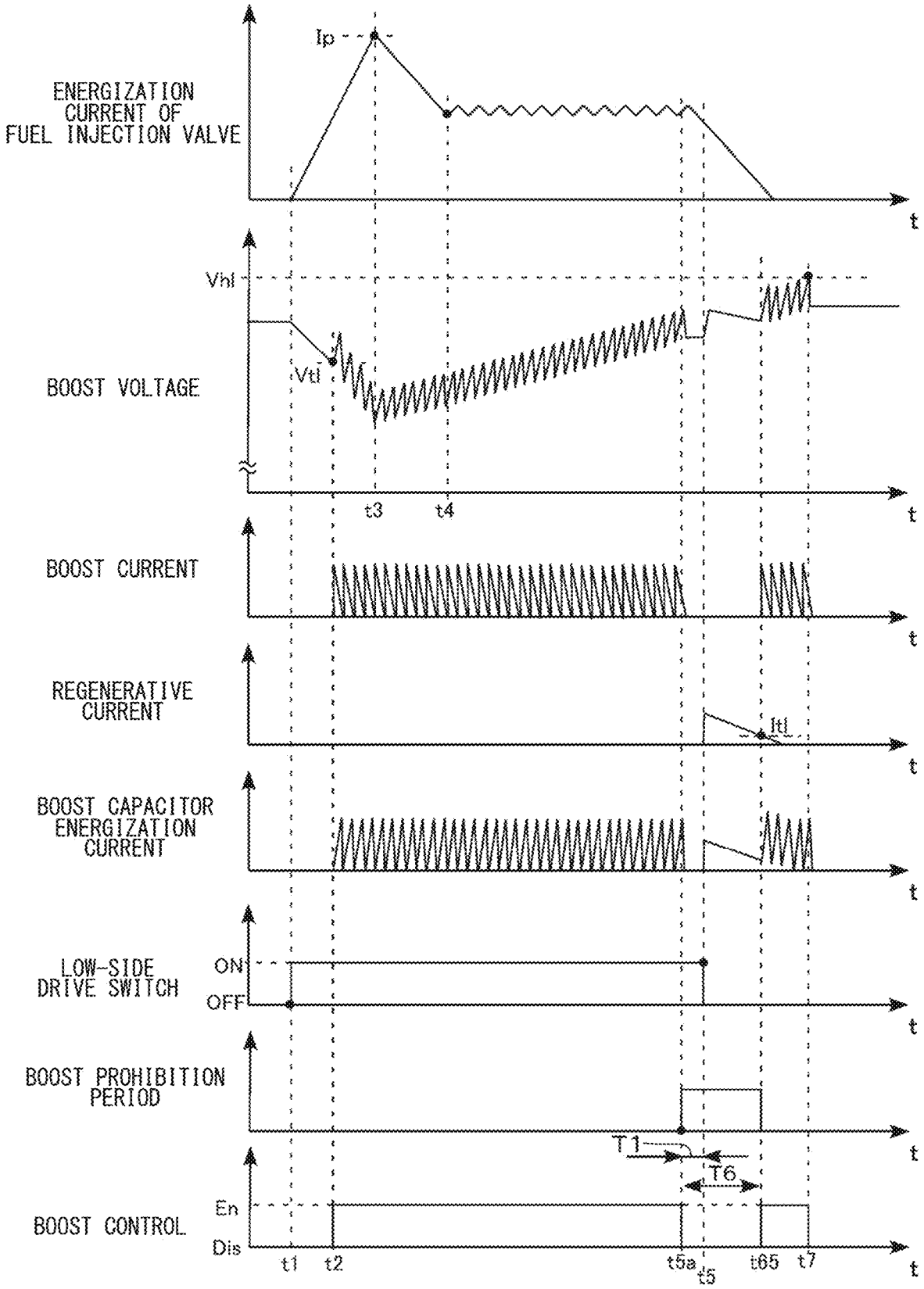
FIG. 12 is a timing chart schematically showing a signal change of each part according to the fifth embodiment.

FIGS. 10 to 12 show additional explanatory views of the fifth embodiment. As shown in FIG. 10, an electronic control device 501 of the fifth embodiment further includes an electric current detection resistor 22. As shown in FIG. 10, the electric current detection resistor 22 is provided in an energization path in which a regenerative current from the fuel injection valves 2*a*, 2*b* flows to the boost capacitor 12 through the diodes 21*a*, 21*b*, and is used to detect the regenerative current that occurs in the regeneration unit 21 when the power interruption controller 6*bb* performs the interruption control.

As illustrated in the control contents in FIG. 11, a current detector 6*j* of the control circuit 6 is configured to monitor the voltage across the electric current detection resistor 22 (descriptively known as a "regenerative current resistor"). A current determiner 6*l* compares the regenerative current detected by the current detector 6*j* and a predetermined first current ItI and determines, and outputs a permission signal to the boost controller 6*a* based on the determination result.

As shown in FIG. 12, the regenerative current sharply increases and gradually decreases from timing t5 at which the control circuit 6 inputs the injection stop instruction and the power interruption controller 6*bb* performs the interruption control. The current determiner 6*l* outputs a permission signal to the boost controller 6*a* at timing t65 (see FIG. 12) when it is determined that the regenerative current detected by the current detector 6*j* falls below (reaches) the predetermined first current ItI (descriptively known as a threshold-terminating regenerative current). Thus, the boost controller 6*a* stops boost control in a boost prohibition period T6 between timings t5 and t65. After the lapse of the boost prohibition period T6, the boost controller 6*a* starts boost control from timing t65.

According to the present (fifth) embodiment, the boost control of the booster circuit 4 by the boost controller 6*a* is stopped from a stop timing of the boost control (at t5*a*) until the regenerative current of the regeneration unit 21 falls below the predetermined first current ItI. As a result, the same effect as that of the above-described embodiment is achievable.

Sixth Embodiment

Figure 13:
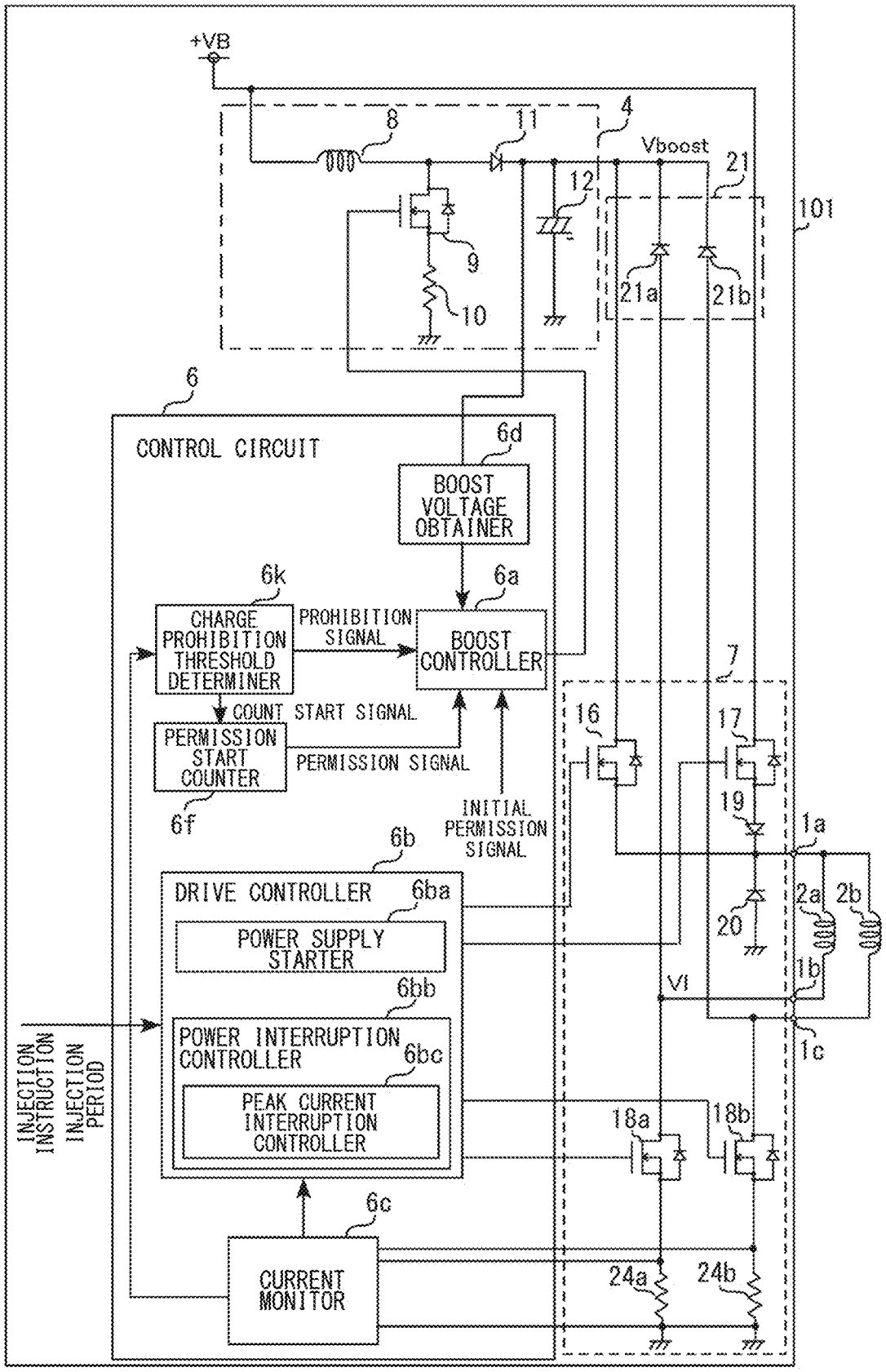
FIG. 13 is a diagram schematically illustrating the control contents in the control circuit according to a sixth embodiment.
Figure 14:
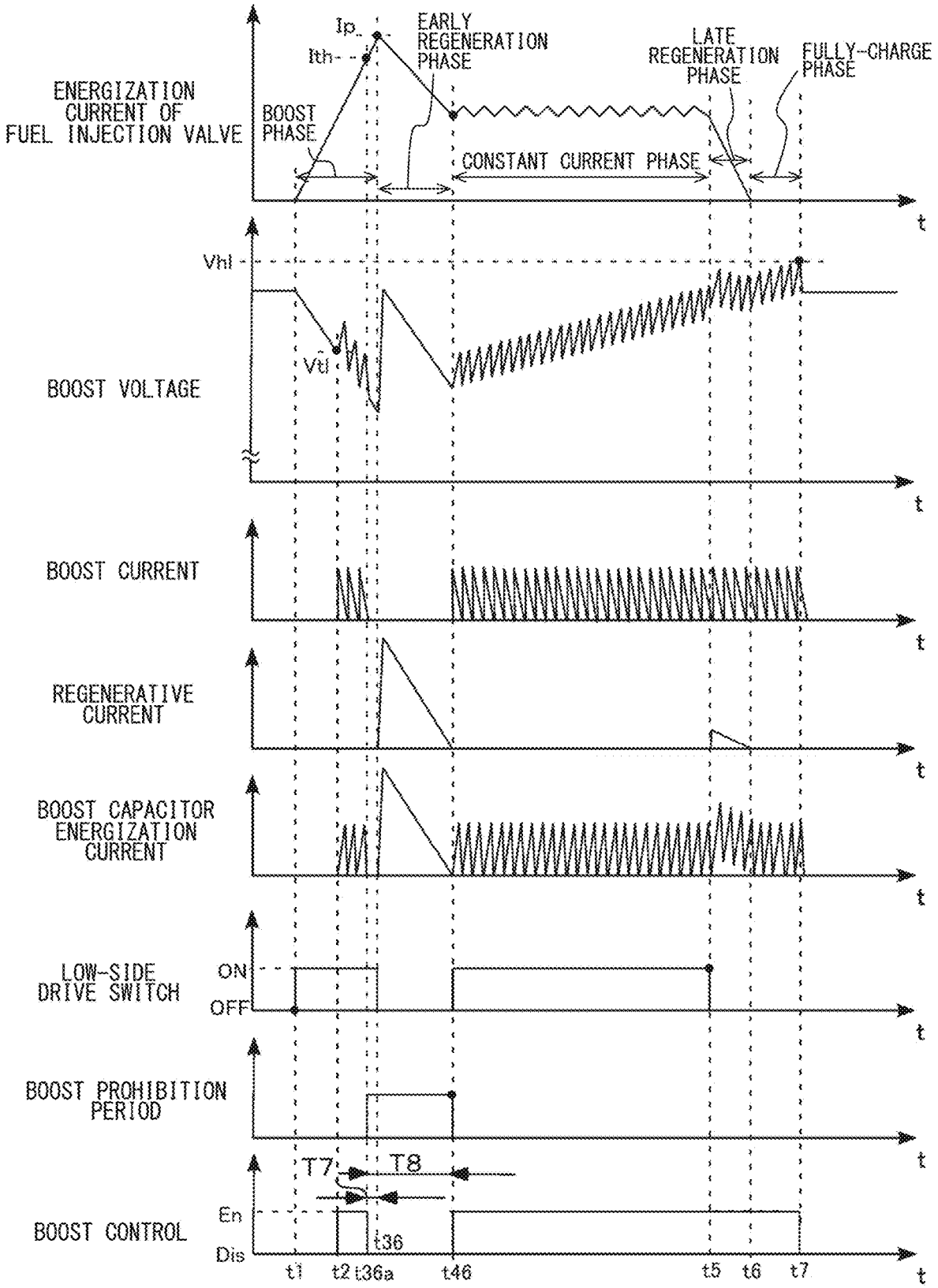
FIG. 14 is a timing chart schematically showing a signal change of each part according to the sixth embodiment.

FIGS. 13 and 14 show additional explanatory diagrams of the second embodiment. The same parts as those of the first embodiment are designated by the same reference numerals and the description thereof is omitted. Below, only the parts different from the first embodiment are described.

As shown in FIG. 13, the control circuit 6 includes a charge prohibition threshold determiner 6*k*. The drive controller 6*b* includes a power supply starter 6*ba* and a power supply interrupter 6*bb*, and the power supply interrupter 6*bb* includes a peak current interrupter 6*bc*.

The charge prohibition threshold determiner 6*k* has a function of determining whether an electric current of current detection resisters 24*a*, 24*b* monitored by the current monitor 6*c* has reached a charge prohibition threshold Ith that is set to a lower value than the peak current threshold Ip in advance. The peak current interrupter 6*bc* has a function of performing interruption control of the voltage applied to the fuel injection valves 2*a*, 2*b* by turning OFF the (boost voltage) discharge switch 16 and the low-side switches 18*a*, 18*b* when the current monitor 6*c* detects that the electric current supplied to the fuel injection valves 2*a*, 2*b* has reached the peak current threshold Ip.

As shown in FIG. 14, the supply of electric current to the fuel injection valves 2*a*, 2*b* rises from start timing t1 of the injection instruction period. The charge prohibition threshold determiner 6*k* determines that the supply of electric current to the fuel injection valves 2*a*, 2*b* has reached the charge prohibition threshold Ith at timing t36*a*. Then, the charge prohibition threshold determiner 6*k* outputs a prohibition signal to the boost controller 6*a*, and outputs a count start signal to the permission start counter 6*f*. The boost controller 6*a* stops boost control at timing 36*a*.

Thereafter, though the supply of electric current to the fuel injection valves 2*a*, 2*b* keeps rising, the drive controller 6*b* interrupts the supply of electric current by controlling the peak current interrupter 6*bc* at timing t36 to turn OFF the discharge switch 16 and the low-side drive switch 18*a*, upon detecting the electric current reaching the peak current threshold Ip by the current monitor 6*c*.

After interrupting the supply of electric current, the accumulated energy in the fuel injection valve 2*a* causes an electric current to flow from the reflux diode 20 to the boost capacitor 12 via the diode 21*a* as a regenerative current. As a result, the regenerative current supplied to the boost capacitor 12 raises the boosted voltage Vboost that is charged to the boost capacitor 12, thereby enabling reuse of the accumulated energy in the fuel injection valve 2*a*.

The permission start counter 6*f* starts counting after receiving an input of the count start signal at timing t3*a*, and outputs a permission signal to the boost controller 6*a* after the lapse of a predetermined period T8 (equivalent to a predetermined second period) at timing t46. The predetermined period T8 is set in advance to a duration of time that is required for sufficiently lowering the regenerative current generated at the peak current interruption time. Then, the boost controller 6*a* restarts boost control. The operation thereafter is omitted from the description.

As shown in FIG. 14, the boost current largely fluctuates/changes everytime the boost controller 6*a* turns ON/OFF the MOS transistor 9. Thus, depending on the last OFF timing of the MOS transistor 9, the boost current and the regenerative current may overlap, and the boosted voltage Vboost may temporarily exceed the full-charge threshold Vht. However, the control method of the present embodiment stops the boost control of the boost controller 6*a* at timing t36*a*, which precedes detection timing t36 of the peak current threshold Ip with a margin of the predetermined period T7 (equivalent to the predetermined first period T1). Therefore, the excess of the boosted voltage Vboost reaching the full-charge threshold VhI is securely preventable. In such manner, false detection of the full-charge threshold VhI is securely avoidable.

The boost controller 6*a* stops boost control of the booster circuit 4 before interruption control of the supply of electric power to the fuel injection valve 2*a*, and from timing t36*a*, i.e., when it is determined that the charge prohibition threshold Ith is reached after start timing t1 of the injection instruction period, and at least during a time when the electric current is regenerated by the regenerative unit 21 to the boost capacitor 12 of the boost circuit 4.

Further, the boost controller 6*a* stops the boost control of the booster circuit 4 for the predetermined period T8 from timing t36*a* which precedes timing t36 at which the peak current threshold value Ip is detected by an amount of the predetermined period T7.

In such manner, the same effect as the above-described embodiment is achievable.

(Modification)

Further, in addition to the configuration of the charge prohibition threshold determiner 6*k* shown in the sixth embodiment, if each constituent element in the control circuit 6 in the description of the first to fifth embodiments is provided, the interruption control related to constant current can be applied at the same time as described above.

Figure 15:
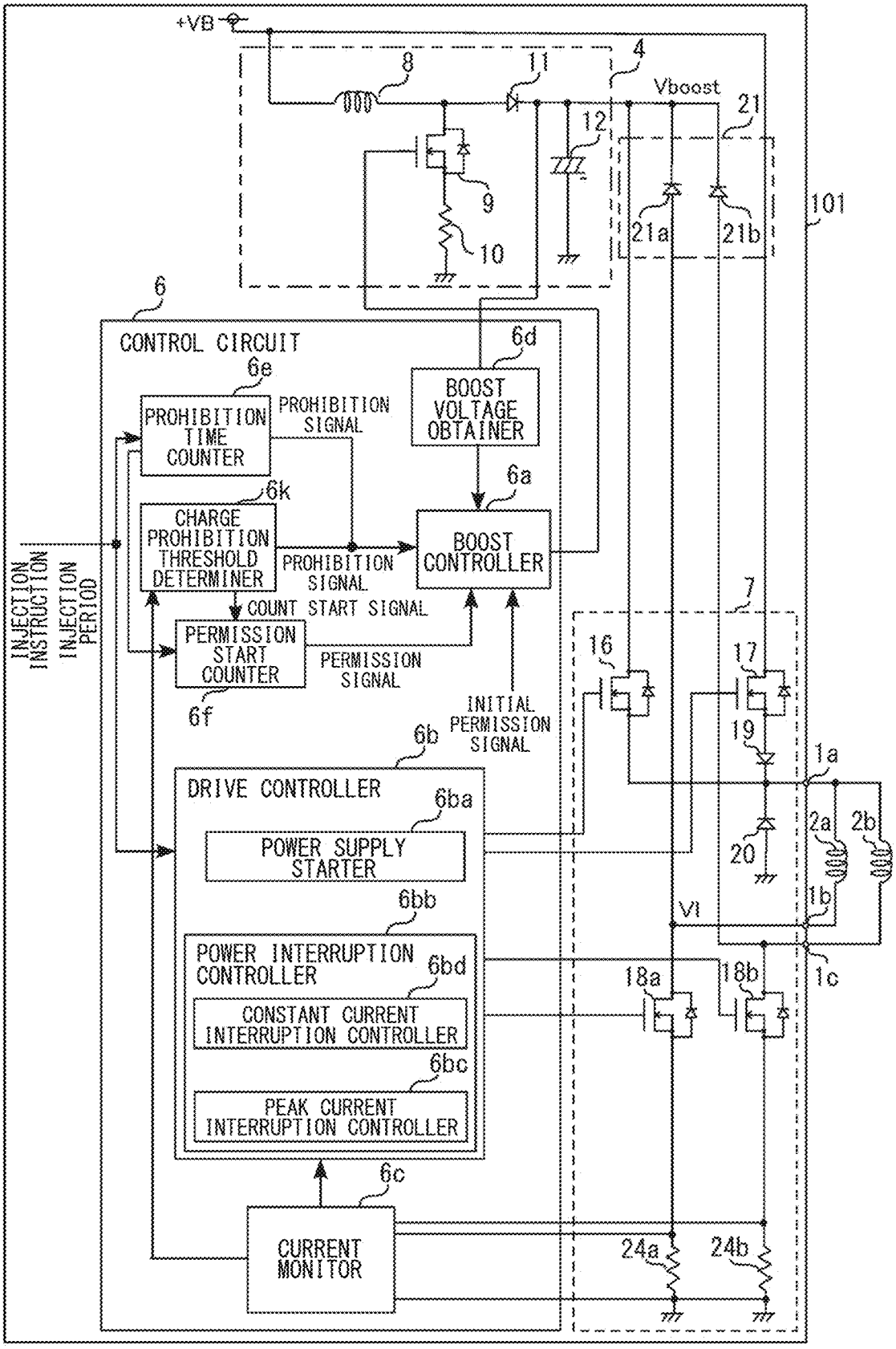
FIG. 15 is a diagram schematically illustrating the control contents in the control circuit according to a modification.

For example, when the prohibition time counter 6*e* shown in the first embodiment is provided in combination, the control contents can be described as shown in FIG. 15. As shown in FIG. 15, the power interruption controller 6*bb* includes the peak current interrupter 6*bc* and a constant current interrupter 6*bd*. The constant current interrupter 6*bd* interrupts the constant current.

Figure 16:
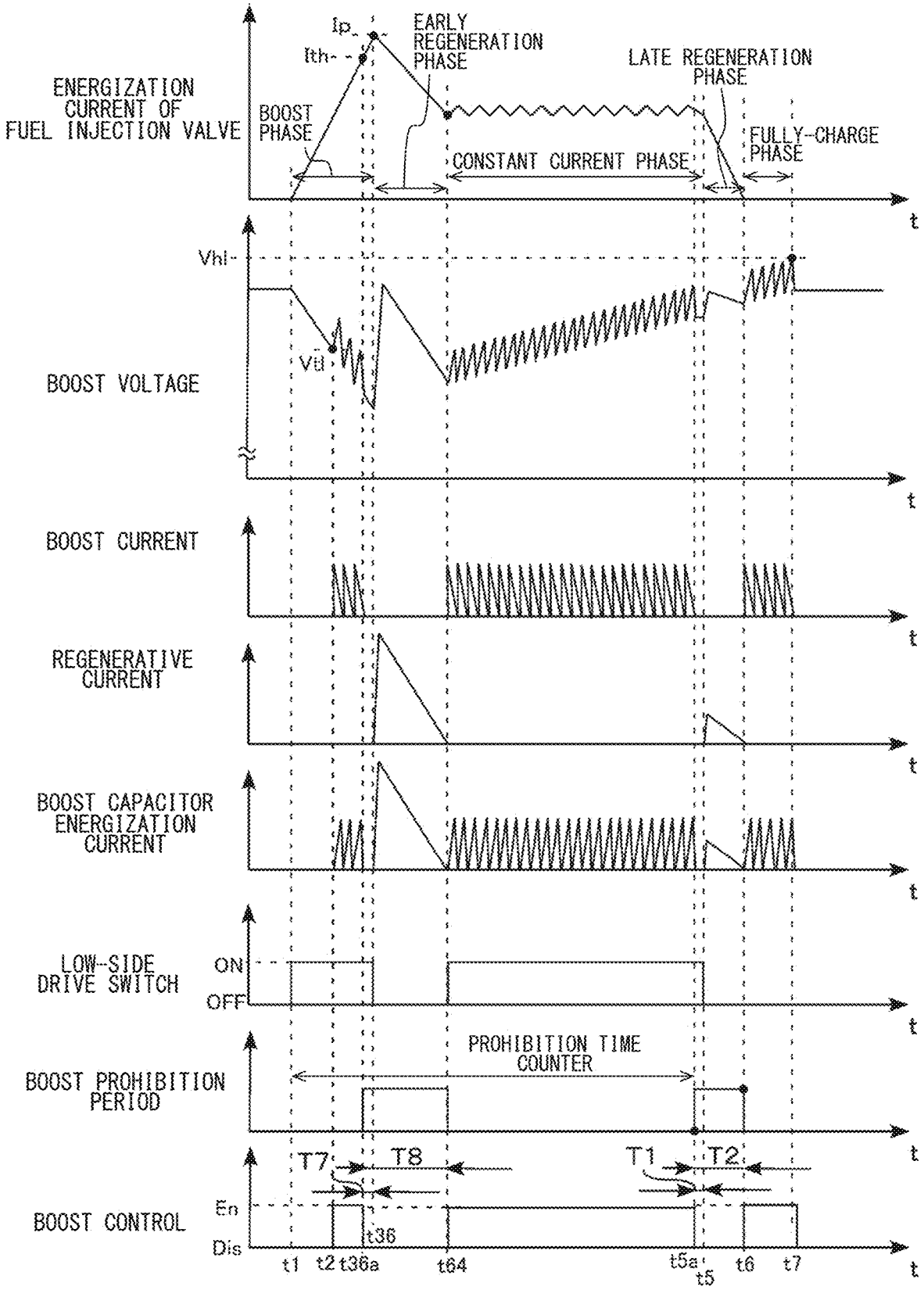
FIG. 16 is a timing chart schematically showing a signal change of each part according to the modification.

As shown in FIG. 16, the supply of the electric current to the fuel injection valve 2*a* starts to increase from start timing t1 of the injection instruction period, but the charge prohibition threshold determiner 6*k* determines that the supply of electric current to the fuel injection valve 2*a* reaches the charge prohibition threshold Ith at timing t36*a*. Then, the charge prohibition threshold determiner 6*k* outputs a prohibition signal to the boost controller 6*a*, and outputs a count start signal to the permission start counter 6*f*. The boost controller 6*a* stops boost control at timing t36*a*.

After that, when the current monitor 6*c* detects that the electric current has reached the peak current threshold Ip, the drive controller 6*b* interrupts the supply of electric power by controlling the peak current interrupter 6*bc* to turn OFF the discharge switch 16 and the low-side drive switch 18*a* at timing t36.

After interrupting the supply of electric current, the accumulated energy in the fuel injection valve 2*a* causes an electric current to flow from the reflux diode 20 to the boost capacitor 12 via the diode 21*a* as a regenerative current. As a result, the regenerative current supplied to the boost capacitor 12 raises the boosted voltage Vboost that is charged to the boost capacitor 12, thereby enabling reuse of the accumulated energy in the fuel injection valve 2*a*.

The permission start counter 6*f* starts counting after receiving an input of the count start signal at timing t36*a*, and outputs a permission signal to the boost controller 6*a* after the lapse of the predetermined period T8 (equivalent to a predetermined second period) at timing t64. The predetermined period T8 is set in advance to a duration of time that is required for sufficiently lowering the regenerative current generated at the peak current interruption time. Then, the boost controller 6*a* restarts boost control.

Further, the power supply starter 6*ba* of the drive controller 6*b* performs a constant current control at timing t64 by turning ON the low-side drive switch 18*a* and by tuning ON/OFF the constant current switch 17. On the other hand, the prohibition time counter 6*e*, having kept on counting from start timing t1 of the injection instruction period to timing t5, outputs a prohibition signal to the boost controller 6*a* at timing t5*a* to stop the boost control. Further, the prohibition time counter 6*e* outputs a count start signal to the permission start counter 6*f* at timing t5*a*. Then, the constant current interrupter 6*bd* of the drive controller 6*b* interrupts the constant current at timing t5 by performing an OFF control for turning OFF all of the constant current switch 17 and the low-side drive switch 18*a*.

In such case, the energization current of the fuel injection valve 2*a* sharply decreases, and the magnetization of the stator provided in the fuel injection valve 2*a* can be stopped. As a result, a needle inside the fuel injection valve 2*a*, which is attracted by an electro-magnet of the stator, is returned to its original position by a biasing force of a biasing unit in response to the disappearance of the electromagnetic force, and as a result, the fuel injection valve 2*a* is closed.

At timing t5 in FIG. 16, electric current is being supplied to the fuel injection valve 2*a*, and electric energy is accumulated therein. The regeneration unit 21 can supply a regenerative current based on the accumulated/stored energy to the boost capacitor 12 through the reflux diode 20 and the diode 21*a*. The boosted voltage Vboost of the boost capacitor 12 is charged with electric energy based on the regenerative current of the regeneration unit 21, and the energy accumulated/stored in the fuel injection valve 2*a* can be reused.

The permission start counter 6*f* outputs the permission signal to the boost controller 6*a* after the lapse of the predetermined second period T2 from timing t5*a* to timing t6. The boost controller 6*a* restarts boost control. The boost controller 6*a* may have, as described above, the control contents of the first embodiment combined/applicable in the present embodiment. The control contents of the second to fifth embodiments can also be combined with the control contents of the sixth embodiment, but the description thereof is omitted.

OTHER EMBODIMENTS

The present disclosure should not be limited to the embodiments described above, and various modifications may further be implemented without departing from the gist of the present disclosure. For example, the following modifications or extensions are possible. The plurality of embodiments described above may be combined as necessary.

In the above-described embodiment, the control method for the one fuel injection valve 2*a* has been described as an example, but the present disclosure is not limited to such a scheme, and the control method of the one fuel injection valve 2*a* can be applied to the control method for the other fuel injection valve 2*b*.

Although the above-described electronic control devices 1 and 501 have been described as used in a mode in which the constant current control is performed after detecting the peak current threshold Ip of the energization current of the fuel injection valve 2*a*, the present disclosure is not limited to such a scheme. For example, the present disclosure can be applied to a control in which the detection of the peak current threshold Ip is used as a trigger to interrupt the constant current control thereafter as a closure of a circuit. Further, for example, the present disclosure can be applied to a control that performs only the constant current control described above without performing the detection and control of the peak current threshold Ip for opening the valve. That is, the present disclosure can be similarly applied to a case where at least one of the interruption control triggered by detecting the peak current threshold Ip and the interruption control after performing the constant current control. Further, the configuration of the drive unit 7 is not limited to the one described in the above-mentioned embodiments but may be changed arbitrarily.

The microcomputer 5 and the control circuit 6 may be integrated or separated, and various control devices may be used instead of the microcomputer 5 and the control circuit 6. The means and/or functions provided by the control device can be provided by software recorded in a substantive memory device and a computer, software, hardware, or a combination thereof that executes the software. For example, when the control device is provided by an electronic circuit that is hardware, it can be configured by a digital circuit or an analog circuit including one or a plurality of logic circuits. Further, for example, when the control device implements various controls by using software, a program is stored in a storage unit, and a method corresponding to the program is performed by the control subject (i.e., by a device) that executes such program.

The above embodiments are described that the discharge switch 16, the constant current switch 17, and the low-side drive switches 18*a*, 18*b* are implemented as the MOS transistor. However, other transistors such as a bipolar transistor and the like may also usable as well.

Two or more embodiments described above may be combined to implement the control of the present disclosure. In addition, the reference numerals in parentheses described in the claims simply indicate correspondence to the concrete means described in the embodiments, which is an example of the present disclosure. That is, the technical scope of the present disclosure is not necessarily limited thereto. A part of the above-described embodiment may be dispensed/dropped as long as the problem identified in the background is resolvable. In addition, various modifications from the present disclosure in the claims are considered also as an embodiment thereof as long as such modification pertains to the gist of the present disclosure.

Although the present disclosure has been described based on the above-described embodiments, it is understood that the present disclosure is not limited to the embodiments and structures. The present disclosure also includes various modifications and the equivalents. In addition, various combinations and forms, and other combinations and forms including one or more elements, or less than one element are also included in the scope and concept of the present disclosure.

VtI is the charge-start threshold in FIGS. 3, 5, 7, 9, 12, 14, and 16.

VhI is the full-charge threshold in FIGS. 3, 5, 7, 9, 12, 14, and 16.

Ip is the peak current threshold in FIGS. 3, 5, 7, 9, 12, 14, and 16, and may be used to turn OFF the boosting voltage discharge switch 16.

VIt is the predetermined first voltage in FIG. 5, and is descriptively known as a "threshold-terminating low-side voltage", because it terminates the boost prohibition period T3. Terminating the boost prohibition period is equivalent to enabling the boost control in FIG. 5.

VId is the predetermined negative threshold in FIG. 7, and is descriptively known as a "threshold-terminating-first-order low-side value", because it terminates the boost prohibition period T4 based on a first-order differential value of the low-side voltage.

VIId is the predetermined negative threshold in FIG. 9, and is descriptively known as a "threshold-terminating-second-order low-side value", because it terminates the boost prohibition period T5 based on a second-order differential value of the low-side voltage.

ItI is the predetermined first current in FIG. 12, and is descriptively known as a "threshold-terminating regenerative current", because it terminates the boost prohibition shift period T6.

Ith is the charge prohibition threshold in FIGS. 14 and 16, and is descriptively known as a "threshold-initiating energization current" because it initiates the boost prohibition period T8 in FIGS. 14 and 16.

What is claimed is:

1. An injection control device for controlling injection by supplying electric current to a fuel injection valve, the injection control device comprising:

a booster circuit boosting a battery voltage to generate a boosted voltage in a boost capacitor;

a boost controller configured to perform a boost control by the booster circuit, including starting the boost control when the boosted voltage falls below a charge-start threshold, and ending the boost control when the boosted voltage rises to a full-charge threshold;

a drive circuit supplying an energization current to the fuel injection valve with the boosted voltage or with the battery voltage after a start timing of an injection instruction period;

a power interruption controller configured to interrupt the energization current supplied by the drive circuit to the fuel injection valve; and a regeneration unit passing a regenerative current from the fuel injection valve to the boost capacitor of the booster circuit, wherein the regenerative current is caused by an interruption control of the power interruption controller, wherein the boost controller is configured to stop the boost control by the booster circuit during a boost prohibition period, wherein the boost prohibition period at least partly includes passing the regenerative current caused by the interruption control, wherein the boost prohibition period begins a fixed period of time after a start time of an injection period, and wherein the interruption control begins after the boost prohibition period begins.

2. The injection control device according to claim 1, wherein the power interruption controller performs the interruption control as at least one of:

interruption of a booster circuit current supplied from the start timing of the injection instruction period to the fuel injection valve by an application of the boosted voltage to the fuel injection valve by the drive circuit, wherein the interruption of the booster circuit current begins when the energization current reaches a peak current threshold, and interruption of a constant current supplied to the fuel injection valve by an application of the battery voltage by the drive circuit.

3. The injection control device according to claim 1, wherein the boost controller begins the boost prohibition period at a predetermined first period before the injection period terminates, and wherein the boost prohibition period includes at least some time during which the regenerative current charges the boost capacitor.

4. The injection control device according to claim 1, wherein the boost controller performs the boost prohibition period:

(i) starting at a time (a) that is before starting the interruption control of the energization current and (b) that is after determination that the energization current has reached a charge- prohibition threshold after the start timing of the injection instruction period, and (ii) including at least some regenerative charging of the boost capacitor of the booster circuit by the regeneration unit.

5. The injection control device according to claim 1, wherein the boost controller performs the boost prohibition period:

(i) starting a predetermined first period before an end of the injection period, and (ii) continuing for a predetermined second period.

6. The injection control device according to claim 1 further comprising:

a current detector detecting the regenerative current, wherein the boost controller performs the boost prohibition period:

(i) starting a predetermined first period before the interruption control performed by the power interruption controller, and (ii) stopping when the regenerative current falls below a predetermined first current.

7. The injection control device according to claim 1 further comprising:

a voltage detector detecting a flyback voltage generated in the fuel injection valve when the interruption control is performed by the power interruption controller, wherein the boost controller performs the boost prohibition period that terminates when the flyback voltage drops below a predetermined first voltage.

8. The injection control device according to claim 1 further comprising:

a voltage detector detecting a flyback voltage generated in the fuel injection valve when the interruption control is performed by the power interruption controller, and a differential processor differentiating the flyback voltage once, wherein the boost controller performs the boost prohibition period:

(i) beginning before the interruption control performed by the power interruption controller, and (ii) ending upon a satisfaction of a predetermined condition based on a first-order differential value of the flyback voltage.

9. The injection control device according to claim 1 further comprising:

a voltage detector detecting a flyback voltage generated in the fuel injection valve when the interruption control is performed by the power interruption controller, and a second-order differential processor differentiating the flyback voltage twice, wherein the boost controller performs the boost prohibition period:

(i) beginning before the interruption control performed by the power interruption controller, and (ii) ending upon a satisfaction of a predetermined condition based on a first-order differential value of the flyback voltage.

10. An injection control device comprising:

a control circuit;

a booster circuit configured to generate a boost voltage, and including: a boost inductor, a boost switch, a boost resister, a boost diode, and a boost capacitor;

a regenerative circuit configured to pass a regenerative current towards the booster circuit;

a discharge switch located electrically between the booster circuit and a fuel injection valve;

a constant current switch located electrically between a battery voltage and the fuel injection valve;

a high side terminal configured for connection to the fuel injection valve;

a low side terminal configured for connection to a low side of the fuel injection valve, and associated with a low-side voltage;

a low-side drive switch; and a current detection resistor configured to receive current from the low-side drive switch, wherein the control circuit is configured to:

(i) start charging the boost capacitor by controlling the boost switch when the boost voltage is equal to or smaller than a charge-start threshold; and (ii) stop charging the boost capacitor by controlling the boost switch when the boost voltage is equal to or greater than a full-charge threshold;

(iii) prohibit the booster circuit from charging the boost capacitor using the boost switch during a boost prohibition period; and (iv) charge the boost capacitor using the regenerative current at least during at least part of the boost prohibition period; and (v) the boost prohibition period is started before a power interruption controller interrupts electric current supplied by a drive circuit to the fuel injection valve.

11. The injection control device according to claim 10, wherein the control circuit is configured to consider the boost prohibition period, including:

at a first time, begin a boost phase including turning ON the low-side drive switch;

at a second time, start charging the boost capacitor by controlling the boost switch because the boost voltage is equal to or smaller than the charge-start threshold;

at a third time: (i) determine that an energization current is equal to or greater than a peak current, (ii) terminate the boost phase, and (iii) begin a constant current phase;

at a fourth time, turn ON the constant current switch, and perform an ON/OFF control of the constant current switch;

at a fifth time, after a prohibition time has passed with respect to the first time, begin the boost prohibition period;

at a sixth time, after a predetermined period has passed with respect to the fifth time, end the constant current phase and begin a regeneration phase by: (i) turning OFF the constant current switch, and (ii) turning OFF the low-side drive switch to interrupt the energization current;

at a seventh time, upon determining that the boost prohibition period has passed with respect to the fifth time, end the boost prohibition period and begin a fully-charge phase; and at an eighth time: (i) determine that the boost voltage is equal to or greater than the full-charge threshold, and (ii) end the fully-charge phase.

12. The injection control device according to claim 10, wherein the control circuit is configured to consider a threshold-terminating low-side voltage, including:

at a first time, begin a boost phase including turning ON the low-side drive switch;

at a second time, start charging the boost capacitor by controlling the boost switch because the boost voltage is equal to or smaller than the charge-start threshold;

at a third time: (i) determine that an energization current of the fuel injection valve is equal to or greater than a peak current, (ii) terminate the boost phase, and (iii) begin a constant current phase;

at a fourth time, turn ON the constant current switch, and perform an ON/OFF control of the constant current switch;

at a fifth time, after a prohibition time has passed with respect to the first time, begin the boost prohibition period;

at a sixth time, after a predetermined period has passed with respect to the fifth time, end the constant current phase and begin a regeneration phase by: (i) turning OFF the constant current switch, and (ii) turning OFF the low-side drive switch to interrupt the energization current;

at a seventh time, upon determining the low-side voltage is equal to or smaller than the threshold-terminating low-side voltage, end the boost prohibition period and begin a fully-charge phase; and at an eighth time: (i) determine that the boost voltage is equal to or greater than the full-charge threshold, and (ii) end the fully-charge phase.

13. The injection control device according to claim 10, wherein the control circuit is configured to consider a threshold-terminating-first-order low-side value, including:

at a first time, begin a boost phase including turning ON the low-side drive switch;

at a second time, start charging the boost capacitor by controlling the boost switch because the boost voltage is equal to or smaller than the charge-start threshold;

at a third time: (i) determine that an energization current of the fuel injection valve is equal to or greater than a peak current, (ii) terminate the boost phase, and (iii) begin a constant current phase;

at a fourth time, turn ON the constant current switch, and perform an ON/OFF control of the constant current switch;

at a fifth time, after a prohibition time has passed with respect to the first time, begin the boost prohibition period;

at a sixth time, after a predetermined period has passed with respect to the fifth time, end the constant current phase and begin a regeneration phase by: (i) turning OFF the constant current switch, and (ii) turning OFF the low-side drive switch to interrupt the energization current;

at a seventh time, upon determining that a first-order differential value of a low-side current is equal to or smaller than the threshold-terminating-first-order low-side value, end the boost prohibition period and begin a fully-charge phase; and at an eighth time: (i) determine that the boost voltage is equal to or greater than the full-charge threshold, and (ii) end the fully-charge phase.

14. The injection control device according to claim 10, wherein the control circuit is configured to consider a threshold-terminating-second-order low-side value, including:

at a first time, begin a boost phase including turning ON the low-side drive switch;

at a second time, start charging the boost capacitor by controlling the boost switch because the boost voltage is equal to or smaller than the charge-start threshold;

at a third time: (i) determine that an energization current of the fuel injection valve is equal to or greater than a peak current, (ii) terminate the boost phase, and (iii) begin a constant current phase;

at a fourth time, turn ON the constant current switch, and perform an ON/OFF control of the constant current switch;

at a fifth time, after a prohibition time has passed with respect to the first time, begin the boost prohibition period;

at a sixth time, after a predetermined period has passed with respect to the fifth time, end the constant current phase and begin a regeneration phase by: (i) turning OFF the constant current switch, and (ii) turning OFF the low-side drive switch to interrupt the energization current;

at a seventh time, upon determining that a second-order differential value of a low-side current satisfies a condition associated with the threshold-terminating-second-order low-side value, end the boost prohibition period and begin a fully-charge phase; and at an eighth time: (i) determine that the boost voltage is equal to or greater than the full-charge threshold, and (ii) end the fully-charge phase.

15. The injection control device according to claim 10, wherein the control circuit is configured to consider a threshold-terminating regenerative current, including:

at a first time, begin a boost phase including turning ON the low-side drive switch;

at a second time, start charging the boost capacitor by controlling the boost switch because the boost voltage is equal to or smaller than the charge-start threshold;

at a third time: (i) determine that an energization current of the fuel injection valve is equal to or greater than a peak current, (ii) terminate the boost phase, and (iii) begin a constant current phase;

at a fourth time, turn ON the constant current switch, and perform an ON/OFF control of the constant current switch;

at a fifth time, after a prohibition time has passed with respect to the first time, begin the boost prohibition period;

at a sixth time, after a predetermined period has passed with respect to the fifth time, end the constant current phase and begin the regeneration phase by: (i) turning OFF the constant current switch, and (ii) turning OFF the low-side drive switch to interrupt the energization current;

at a seventh time, upon determining that a regenerative current is equal to or smaller than the threshold-terminating regenerative current, end the boost prohibition period and begin a fully-charge phase; and at an eighth time: (i) determine that the boost voltage is equal to or greater than the full-charge threshold, and (ii) end the fully-charge phase.

16. The injection control device according to claim 10, wherein the control circuit is configured to consider a threshold-initiating regenerative current, including:

at a first time, begin a boost phase including turning ON the low-side drive switch;

at a second time, start charging the boost capacitor by controlling the boost switch because the boost voltage is equal to or smaller than the charge-start threshold;

at a third time, upon a determination that an energization current is equal to or greater than a threshold-initiating energization current of the fuel injection valve, begin an early boost prohibition period;

at a fourth time, upon a determination that the energization current is equal to or greater than a peak current threshold: (i) terminate the boost phase by turning OFF the discharge switch, and (ii) begin an early regeneration phase by interrupting the energization current by turning the low-side drive switch OFF, such that the regenerative current flows to the boost capacitor; and at a fifth time, upon a determination that the early boost prohibition period of time has passed relative to the third time: (i) end the early boost prohibition period, and (ii) start a constant current phase by turning ON the low-side drive switch and turning ON the constant current switch, and perform an ON/OFF control of the constant current switch.

* * * * *